US012369626B2

(12) United States Patent
Yang

(10) Patent No.: US 12,369,626 B2
(45) Date of Patent: Jul. 29, 2025

(54) CIGAR CUTTER WITH LOCKING MECHANISM

(71) Applicant: Chun-Kai Yang, Taipei (TW)

(72) Inventor: Chun-Kai Yang, Taipei (TW)

( * ) Notice: Subject to any disclaimer, the term of this patent is extended or adjusted under 35 U.S.C. 154(b) by 417 days.

(21) Appl. No.: 17/947,202

(22) Filed: Sep. 19, 2022

(65) Prior Publication Data

US 2023/0397656 A1 Dec. 14, 2023

(30) Foreign Application Priority Data

Jun. 14, 2022 (TW) ..... 111122090

(51) Int. Cl.
*A24F 13/26* (2006.01)

(52) U.S. Cl.
CPC ..... *A24F 13/26* (2013.01)

(58) Field of Classification Search
CPC ..... A24F 13/24; A24F 13/26
USPC ..... 30/109–113; 131/248–253; D27/195
See application file for complete search history.

(56) References Cited

U.S. PATENT DOCUMENTS 209,387 A * 10/1878 Dillmeier ..... A24F 13/26 131/253
232,864 A * 10/1880 Wienhold ..... A24F 13/26 30/112
242,340 A * 5/1881 Lieb ..... A24F 13/26 30/112
242,690 A * 6/1881 Petzold ..... A24F 13/26 30/112
513,581 A * 1/1894 La Pierre ..... A24F 13/26 30/112
599,878 A * 3/1898 Tabb ..... A24F 13/26 30/112
607,167 A * 7/1898 Fontneau ..... A24F 13/26 30/112
788,425 A * 4/1905 Parris ..... A24F 13/26 30/112
819,875 A * 5/1906 Garrigus ..... A24F 13/26 30/112
835,912 A * 11/1906 Obermayer ..... A24F 13/26 30/112
838,205 A * 12/1906 Nobs, Jr. ..... A24F 13/26 30/112
855,203 A * 5/1907 Schickerling ..... A24F 13/26 30/112

(Continued)

FOREIGN PATENT DOCUMENTS

CA 2124510 A1 * 11/1995 ..... A24F 13/24
CN 1870914 B 5/2012

(Continued)

*Primary Examiner* — Jason Daniel Prone
(74) *Attorney, Agent, or Firm* — CIPO IP Group

(57) ABSTRACT

A cigar cutter having a locking mechanism includes a rotatable ring, an elastic element, a locking assembly and an arresting portion. When a cutting blade unit of the cigar cutter is pressed, the rotatable ring is driven to rotate to compress the elastic element, and the arresting portion will engage with a plate of the locking assembly so that the cigar cutter enters a closed state. When an operation key of the locking assembly is pushed, the plate no longer blocks the arresting portion, and a force of the elastic element will drive the rotatable ring to rotate reversely so that the arresting portion is moved to its original position, thereby keeping the cigar cutter in an open state.

14 Claims, 21 Drawing Sheets

(56) References Cited

U.S. PATENT DOCUMENTS

| | | | | | |
|---|---|---|---|---|---|
| 881,125 | A * | 3/1908 | Holmquist | B26B 11/00 | 30/112 |
| 950,692 | A * | 3/1910 | Garrigus | A24F 13/26 | 30/112 |
| 1,096,219 | A * | 5/1914 | Bippart | A24F 13/26 | 30/112 |
| 1,100,364 | A * | 6/1914 | Fontneau et al. | A24F 13/26 | 30/112 |
| 1,107,950 | A * | 8/1914 | Holsen | B26B 11/00 | 30/112 |
| 1,111,743 | A * | 9/1914 | Graboff | A24F 13/26 | 30/112 |
| 1,124,288 | A * | 1/1915 | Bulman | A24F 13/26 | 30/112 |
| 1,177,098 | A * | 3/1916 | Gay | A24F 13/26 | 30/112 |
| 1,186,291 | A * | 6/1916 | Davis | A24F 13/26 | 30/112 |
| 1,454,994 | A * | 5/1923 | De Matteo | A24F 13/26 | 30/112 |
| 1,504,589 | A * | 8/1924 | Wagner et al. | A24F 13/26 | 30/112 |
| 3,232,298 | A * | 2/1966 | Tomlinson | A24F 13/24 | 131/253 |
| 3,903,598 | A * | 9/1975 | Lefebvre | A24F 13/26 | 30/109 |
| D244,390 | S * | 5/1977 | Zimmermann | D27/195 | |
| 5,303,721 | A * | 4/1994 | Bowen | A24F 13/20 | 131/248 |
| 5,694,691 | A * | 12/1997 | Chen | A24F 13/26 | 30/112 |
| 5,893,212 | A * | 4/1999 | Meister | A24F 13/26 | 30/113 |
| 5,937,523 | A * | 8/1999 | Van Keppel | A24F 13/26 | 30/112 |
| 5,974,668 | A * | 11/1999 | Butzer | A24F 13/24 | 30/112 |
| 5,992,022 | A * | 11/1999 | Carrera Moya | A24F 13/24 | 30/113 |
| 6,076,260 | A * | 6/2000 | Williamson, IV | A24F 13/26 | 30/113 |
| 6,164,286 | A * | 12/2000 | Schad | A24F 13/26 | 30/109 |
| D623,352 | S * | 9/2010 | Melgaard | D27/195 | |
| 9,119,422 | B2 * | 9/2015 | Lance | A24F 13/26 | |
| 9,883,694 | B2 * | 2/2018 | Almsberger | A24F 13/26 | |
| 10,201,184 | B1 * | 2/2019 | Fischer | A24F 13/24 | |
| 10,736,353 | B1 * | 8/2020 | Sharp | A24F 13/26 | |
| 10,820,628 | B2 * | 11/2020 | France | A24F 13/26 | |
| 11,083,218 | B1 * | 8/2021 | Mandeville | A24F 13/26 | |
| 11,344,061 | B2 * | 5/2022 | Rodriguez | A24F 13/26 | |
| 11,856,984 | B2 * | 1/2024 | Fisten | A24F 13/26 | |
| 2007/0089299 | A1 * | 4/2007 | Belaubre | A24F 13/26 | 30/112 |
| 2009/0113719 | A1 * | 5/2009 | Smith | A24F 13/26 | 30/113 |
| 2010/0257741 | A1 * | 10/2010 | Lin | A24F 13/26 | 30/112 |
| 2019/0380384 | A1 | 12/2019 | France | | |
| 2023/0329333 | A1 * | 10/2023 | Yang | A24F 13/26 | |
| 2024/0000139 | A1 * | 1/2024 | Vezina | A24F 13/24 | |
| 2024/0245111 | A1 * | 7/2024 | Senci | A24F 13/26 | |
| 2024/0381931 | A1 * | 11/2024 | Wright | A24F 13/26 | |

FOREIGN PATENT DOCUMENTS

| | | | | | |
|---|---|---|---|---|---|
| CN | 109007973 | A | | 12/2018 | |
| DE | 943622 | C | * | 5/1956 | A24F 13/26 |
| FR | 573811 | A | * | 6/1924 | A24F 13/26 |
| FR | 2480573 | A1 | * | 10/1981 | A24F 13/26 |
| FR | 2821580 | A1 | * | 9/2002 | A24F 13/26 |
| FR | 2827538 | B1 | * | 10/2003 | A24F 13/26 |
| GB | 189707129 | A | * | 5/1897 | A24F 13/24 |
| GB | 191119033 | A | * | 6/1912 | A24F 13/26 |
| JP | 11018745 | A | * | 1/1999 | A24F 13/24 |
| TW | 201817324 | A | | 5/2018 | |

* cited by examiner

CIGAR CUTTER WITH LOCKING MECHANISM

CROSS-REFERENCE TO RELATED PATENT APPLICATION

This non-provisional application claims priority to and the benefit of, under 35 U.S.C. § 119(a), Taiwan Patent Application No. 111122090, filed Jun. 14, 2022 in Taiwan. The entire content of the above identified application is incorporated herein by reference.

FIELD

The present disclosure is related to a cigar cutter, and more particularly to a cigar cutter with a locking mechanism capable of positioning the cigar cutter in a closed state.

BACKGROUND

Although expensive, cigars have been more and more popular thanks to the rise of the standard of living. A cigar generally has a closed end (i.e., the cap). Before smoking a cigar, therefore, a smoker must cut the cap of the cigar, forming the cap into a hollow shape so as to savor the taste and aroma of the cigar after the other end (i.e., the foot) of the cigar is lit.

Nowadays, a cigar cutter is typically used as the tool for cutting the cigar cap. While it is feasible for a cigar smoker to bite the cigar cap open directly with their teeth, doing so will not only fill the smoker's mouth with tobacco leaf pieces, but also make an irregular opening in the cap such that the evenness of burn, and consequently the smoothness of smoking and the taste and flavor, of the cigar are compromised during the smoking process. Only a cigar cutter can cut a proper, smooth opening in a cigar to bring out the flavor of the cigar to the fullest while preventing the wrapper of the cigar from being torn, which if happening will make the cigar surface visually unpleasant.

A common cigar cutter is briefly described below with reference to FIG. 1 and FIG. 2. The cigar cutter 1 includes a bottom casing 11, a top casing 13, a stationary handle 15, and a movable handle 17. The bottom casing 11 and the top casing 13 can be put together to form a housing 10 (as shown in FIG. 2), and are provided with corresponding through holes 110 and 130 respectively. The stationary handle 15 is provided at one end of the bottom casing 1I and is provided with a stationary blade 151. The stationary blade 151 can be received between the bottom casing 11 and the top casing 13 and has a cutting edge covering a portion of the through holes 110 and 130. The movable handle 17 is movably fitted into the opposite end of the bottom casing 11 and is provided with a movable blade 171. The movable handle 17 can be pulled or pushed by a user in order for the movable blade 171 to extend into or be moved out of the housing 10.

With continued reference to FIG. 1 and FIG. 2, the user can move the movable handle 17 in order to bring the cigar cutter 1 into either a closed state, i.e., a state in which the movable blade 171 completely covers the remaining portion of the through holes 110 and 130, or an open state, i.e., a state in which the movable blade 171 does not cover the remaining portion of the through holes 110 and 130 at all (as shown in FIG. 2). While the cigar cutter 1 is in the open state, the user can put the cap C of a cigar into the through holes 110 and 130 and then push the movable handle 17 in order to bring the cigar cutter 1 into the closed state and thereby cut a smooth opening in the cap C.

However, as the movable handle 17 does not have any positioning effect, changing the conventional cigar cutter 1 between the open state and the closed state depends entirely on the user's pulling or pushing the movable handle 17 manually. Such an operation method is evidently not convenient. Moreover, once the cigar cutter 1 is closed and in storage, a relatively strong collision may turn the cigar cutter 1 into the open state by accident. Should that happen, and if the user reaches for the cigar cutter 1 without noticing that it is in the open state, the user may put a finger into the through holes 110 and 130 inadvertently and thus suffer a cut in the finger by the movable blade 171. It is therefore an important issue to be addressed by developers and manufacturers in the cigar industry to improve the conventional cigar cutters so as to provide more convenient and safer user experience.

SUMMARY

In view of the astonishing purchasing power of cigar aficionados for cigar accessories, in which cigar cutters are undoubtedly indispensable everyday carry items, as a result of an extensive research and repeated experiments, the present disclosure provides a cigar cutter with a locking mechanism as disclosed herein. This cigar cutter is intended, among others, to be more useful, easier to operate, and safer than its prior art counterparts, and draw consumers' attention.

Certain aspects of the present disclosure are directed to a cigar cutter having a locking mechanism. The cigar cutter includes a main body, a rotatable ring, an elastic element, at least one cutting blade unit, a locking assembly, and an arresting portion. The main body is formed with a first through hole and a slide hole that is nearer to an edge of the main body than the first through hole is. The rotatable ring can be movably located in the main body, and is formed with at least one first position-limiting track and a second through hole that corresponds to the first through hole. The elastic element can be located in the main body, and has one end that can be fixed to a first positioning portion of the main body, and another end that can be fixed to a second positioning portion of the rotatable ring. The at least one cutting blade unit can be movably mounted to the main body, has one side that can be exposed from the main body and the other side that can extend into the main body, and has a position-limiting post. The elastic element can be compressed when the cutting blade unit is displaced along a direction towards the main body, and can push the cutting blade unit away from the main body and drive the rotatable ring to rotate reversely so that the cigar cutter enters an open state. The first position-limiting track allows the position-limiting post to extend and slide therein. The position-limiting post can: when the cutting blade unit is moved along the direction towards the main body, slide from a first end of the first position-limiting track towards a second end of the first position-limiting track and push the rotatable ring to rotate so as to compress the elastic element until the cigar cutter enters a closed state, wherein the cutting blade unit covers the first through hole and the second through hole in the closed state; and when the cutting blade unit is driven by the elastic element to move along a direction away from the main body, slide from the second end of the first position-limiting track towards the first end of the first position-limiting track through reverse rotation of the rotatable ring driven by the elastic element, so that the cutting blade unit enters the open state, wherein the first through hole and the second through hole are not covered by the cutting blade unit in the open state. The locking assembly can be mounted to the main body, and includes a plate, an operation key, and at least one elastic member. The plate can be located in the main body and has an engaging portion at one end. The operation key can be fixed on the plate, be exposed through the slide hole, and be displaced in the slide hole to drive the plate to move back and forth. The at least one elastic member can be located in the main body, apply a force to the plate, and drive one end of the plate to move along a direction towards the first through hole through the force. The arresting portion can: be displaced together with the rotatable ring when the rotatable ring is rotated; when the cigar cutter is in the open state, not correspond in position to the engaging portion; when the cutting blade unit is pressed and the elastic element is compressed, move along a direction towards the engaging portion until corresponding in position to the engaging portion; and when the cutting blade unit is not pressed and the rotatable ring is driven to rotate reversely by a restoring force of the elastic element to push the cutting blade unit to move, press against the engaging portion to keep the cigar cutter in the closed state. Accordingly, a user needs only to press the at least one cutting blade unit and push the operation key to easily position the cigar cutter at a current state, such as an open state or a closed state, which effectively increases the storage safety for the user and endows the cigar cutter with better operability.

In certain embodiments, the operation key can, when the cigar cutter is in the closed state, move the plate away from the first through hole. The elastic element can, once the arresting portion stops being blocked by the engaging portion, drive the rotatable ring to rotate reversely. The rotatable ring can rotate reversely to drive the position-limiting post to slide from the second end of the first position-limiting track toward the first end of the first position-limiting track and to drive the cutting blade unit to stop covering the first and second through holes, so that the cigar cutter enters the open state and the arresting portion is moved to not correspond in position to the engaging portion.

In certain embodiments, the main body includes a front cover formed with a front through hole, and a rear cover formed with a rear through hole. The front through hole and the rear through hole jointly form the first through hole.

In certain embodiments, the cigar cutter further includes a positioning ring that can be located in the main body and formed with a third through hole and at least one second position-limiting track. The third through hole corresponds to the first through hole, and the position-limiting post can: extend into, and slide in, the first position-limiting track and the second position-limiting track simultaneously; when the cutting blade unit is moved along the direction towards the main body, slide from a first end of the second position-limiting track towards a second end of the second position-limiting track and push the rotatable ring to rotate until the cigar cutter enters the closed state, wherein the cutting blade unit covers the first through hole, the second through hole and the third through hole in the closed state: and when the elastic element drives the rotatable ring to rotate reversely, slide from the second end of the second position-limiting track towards the first end of the second position-limiting track, so that the cutting blade units enters the open state, wherein the first through hole, the second through hole and the third through hole are not covered by the cutting blade unit in the open state.

In certain embodiments, an area of a rear side of the front cover has a front protruding block, an area of a front side of the rear cover has a rear protruding block, and the front protruding block and the rear protruding block are not aligned with and do not correspond in position to each other when the front cover and the rear cover are assembled with each other.

In certain embodiments, a protruding thickness degree of the front protruding block and a protruding thickness degree of the rear protruding block are the same or substantially the same.

In certain embodiments, the engaging portion has an inclined surface and a shoulder portion, the shoulder portion is adjacent to one side of the inclined surface, and the arresting portion is formed as a post and can: when the cigar cutter is in the open state, be located at a position that is closer to a first side of than to a second side of the inclined surface; and when the cutting blade unit is pressed and the elastic element is compressed, move from the first side toward the second side of the inclined surface and push the plate to move away from the first through hole to compress the elastic member. The elastic member can, once the arresting portion moves past the inclined surface, push one end of the plate towards the first through hole, so that the arresting portion corresponds in position to the shoulder portion.

In certain embodiments, the operation key can, when the cigar cutter is in the closed state, be pushed to move the plate away from the first through hole. The elastic element can, once the shoulder portion no longer blocks the arresting portion, drive the rotatable ring to rotate reversely. The rotatable ring can rotate reversely to drive the position-limiting post to slide from the second end of the first position-limiting track toward the first end of the first position-limiting track, to drive the cutting blade unit to stop covering the first and second through holes so that the cigar cutter enters the open state, and to move the arresting portion past the inclined surface again to a position nearer to the first side of than to the second side of the inclined surface.

In certain embodiments, the arresting portion is formed as a notch, is located at an edge of the rotatable ring, and can be extended therein with the engaging portion when the arresting portion moves to a position corresponding to the engaging portion.

In certain embodiments, the positioning ring is formed with at least one first receiving groove, the plate is formed with at least one second receiving groove, the first receiving groove and the second receiving groove can jointly receive the elastic member, and the elastic member can press against a wall of the first receiving groove and a wall of the second receiving groove, respectively.

In certain embodiments, a position of at least one portion of the first position-limiting track superposes on a position of at least one portion of the second position-limiting track.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION

Figure 1:
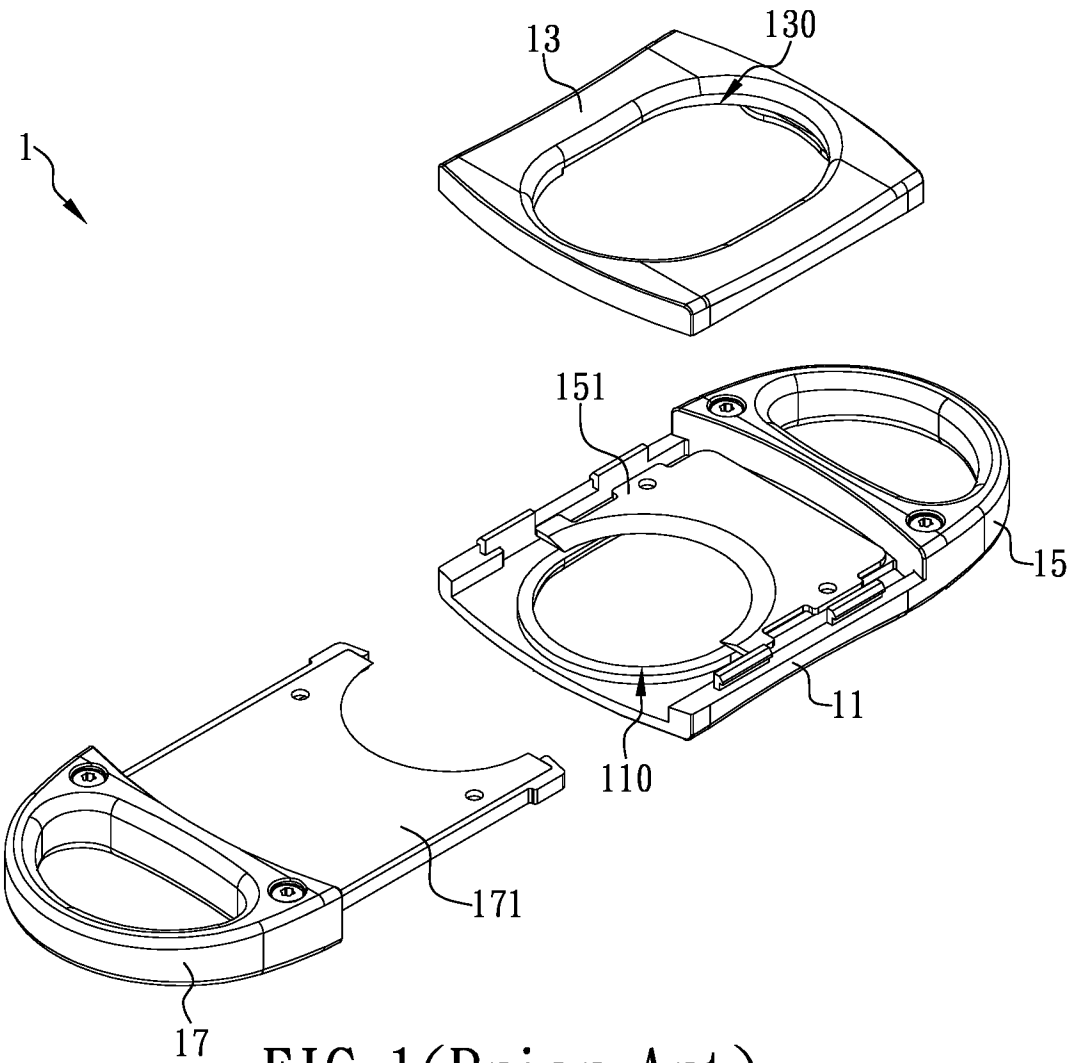
FIG. 1(Prior Art)
FIG. 1 is an exploded view of a conventional cigar cutter.
Figure 2:
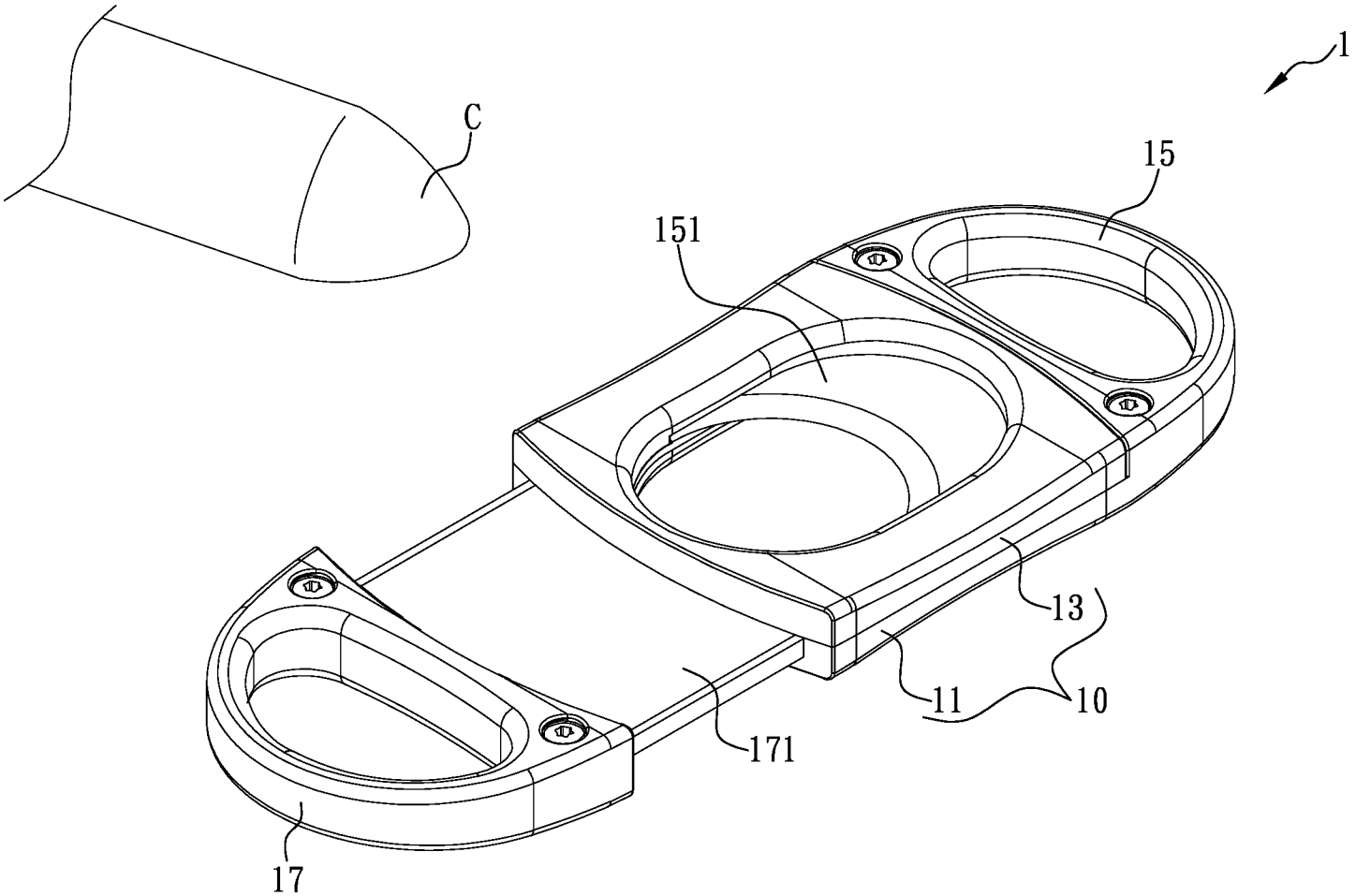
FIG. 2(Prior Art)
FIG. 2 is an assembled view of the conventional cigar cutter.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The accompanying drawings are schematic and may not have been drawn to scale. The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, materials, objects, or the like, which are for distinguishing one component/material/object from another one only, and are not intended to, nor should be construed to impose any substantive limitations on the components, materials, objects, or the like. Directional terms (e.g., "front", "rear", "left", "right", "upper/top" and/or "lower/bottom") are explanatory only and are not intended to be restrictive of the scope of the present disclosure.

As used herein, the term "substantially" refers to, for example, a value, or an average of values, in an acceptable deviation range of a particular value recognized or decided by a person of ordinary skill in the art, taking into account any specific quantity of errors related to the measurement of the value that may resulted from limitations of a measurement system or device. For example, "substantially" may indicate that the value is within, for example, ±5%, ±3%, ±1%, ±0.5% or ±0.1%, or one or more standard deviations, of the particular value.

Figure 3:
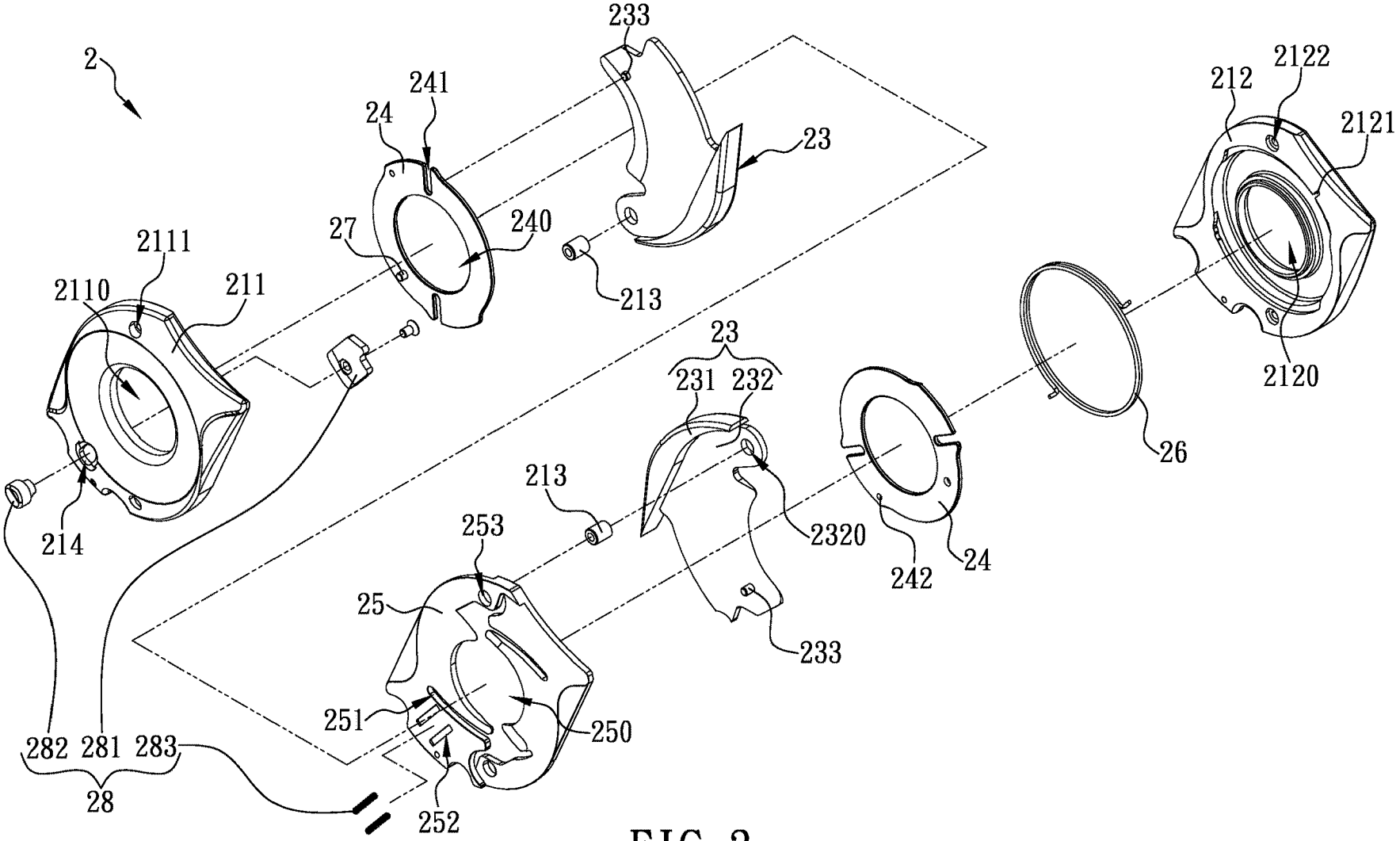
FIG. 3 is an exploded view of a cigar cutter according to certain embodiments of the present disclosure.
Figure 4:
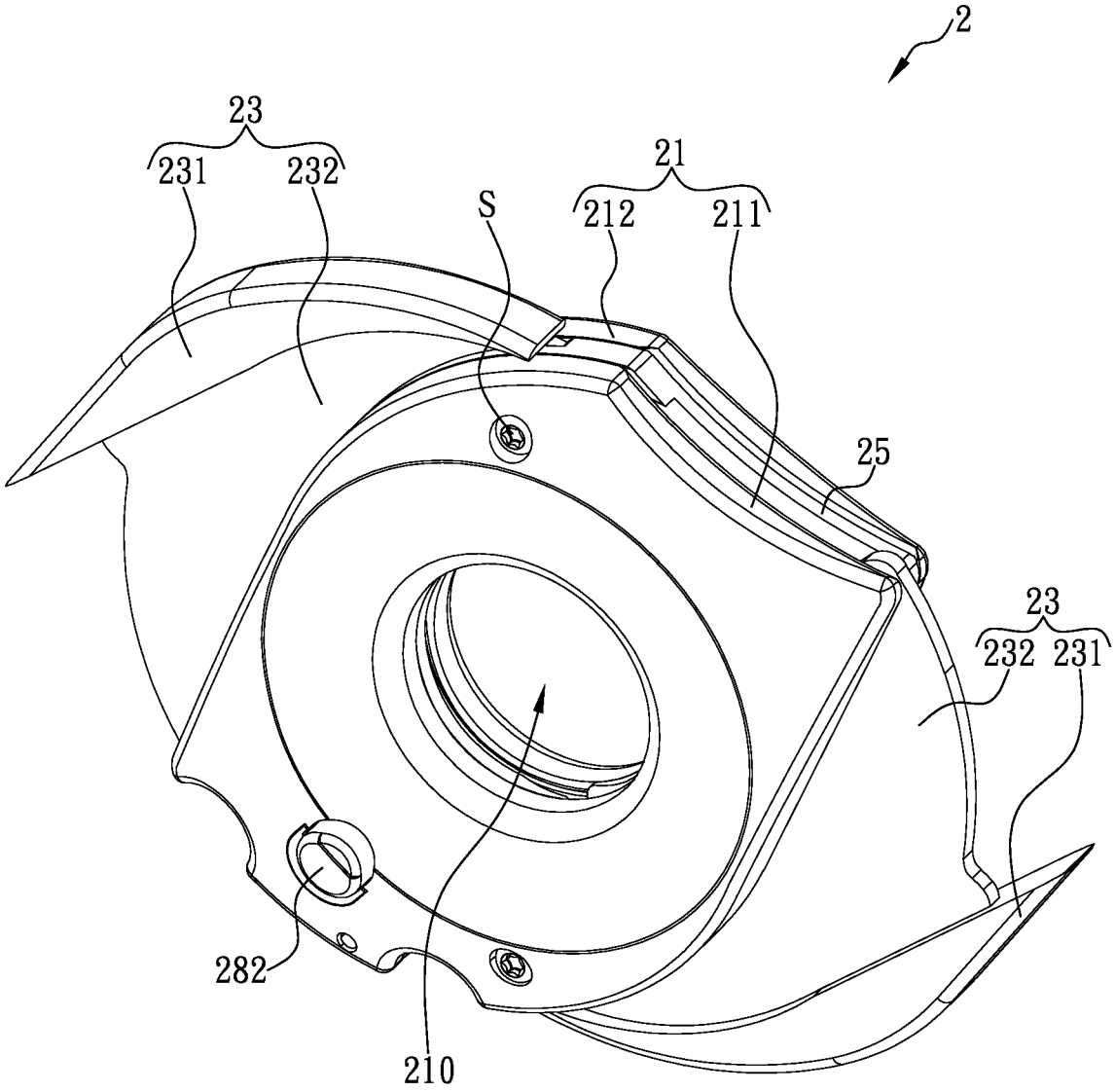
FIG. 4 is a schematic diagram of a cigar cutter in an open state according to certain embodiments of the present disclosure.
Figure 5:
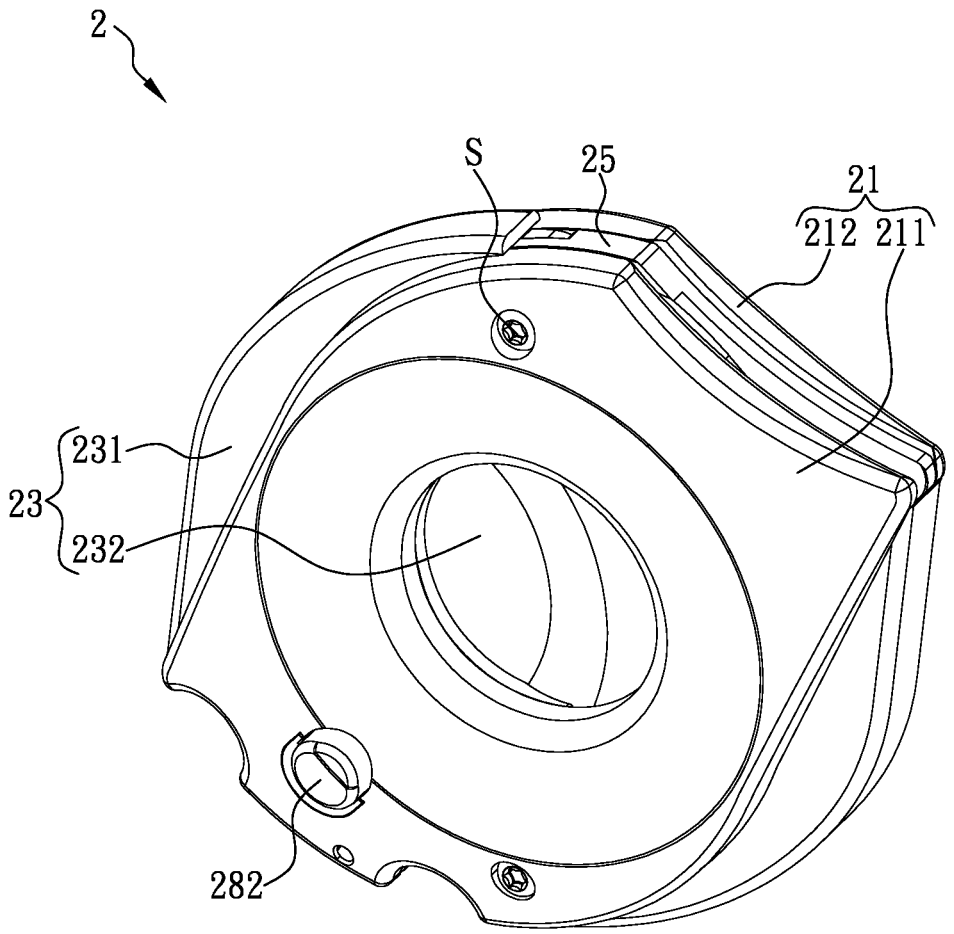
FIG. 5 is a schematic diagram of a cigar cutter in a closed state according to certain embodiments of the present disclosure.

Certain aspects of the present disclosure are directed to a cigar cutter with a locking mechanism. Referring to FIG. 3 to FIG. 5, in certain embodiments, the cigar cutter 2 includes a main body 21, at least one cutting blade unit 23, at least one rotatable ring 24, a positioning ring 25, an elastic element 26, an arresting portion 27 and a locking assembly 28. To facilitate description, the front side of a component is defined as the side facing the lower left corner of FIG. 3, and the rear side as facing the upper right corner of FIG. 3. The main body 21 is formed with a first through hole 210 and a slide hole 214, and the first through hole 210 is open on the front and rear sides of the main body 21, while the slide hole 214 does not penetrate the main body 21 and is nearer to an edge of the main body 21 than the first through hole 210 is. In certain embodiments, the cigar cutter 2 has one first through hole 210. However, the present disclosure is not limited thereto, and in certain embodiments, the number, shape, location and/or size of the first through hole(s) 210 can be adjusted by a manufacturer according to product requirements, for example, for cutting a substantially V-shaped groove in a cigar or clipping off (cutting off) the cigar cap directly.

Figure 6:
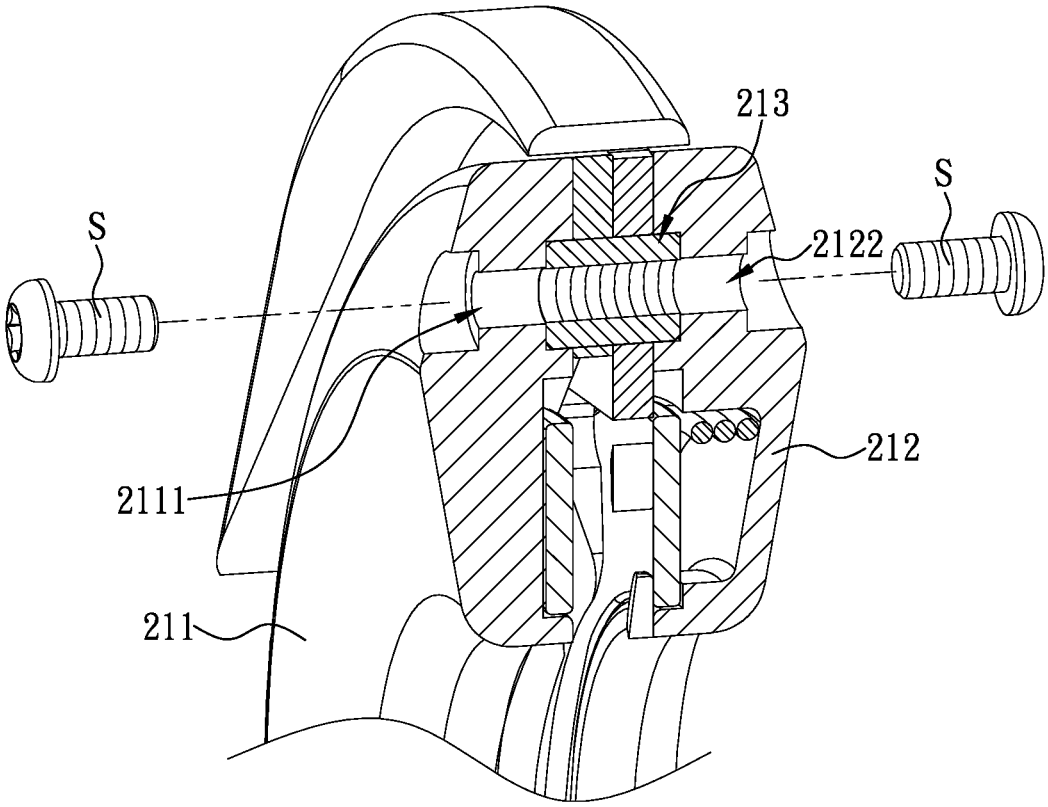
FIG. 6 is a schematic diagram of the assembly relationship between a front cover, a rear cover, a post and a fixing element according to certain embodiments of the present disclosure.

In certain embodiments, referring to FIG. 3 to FIG. 5, the main body 21 includes a front cover 211 and a rear cover 212. The rear cover 212 has a first positioning portion 2121 (e.g., a slit) and is formed with at least one rear through hole 2120. The front cover 211 is formed with at least one front through hole 2110. When the front cover 211 and the rear cover 212 are put together to form the main body 21, the front through hole 2110 and the rear through hole 2120 are in communication with each other and jointly form the first through hole 210; in other words, a user can put a cigar through the corresponding front and rear through holes 2110 and 2120 in this state. In certain embodiments, the front cover 211 is further formed with at least one front assembly hole 2111, the rear cover 212 is formed with at least one rear assembly hole 2122, and at least one post 213 is configured to be disposed between the corresponding front and rear assembly holes 2111 and 2122 (as shown in FIG. 6) so that at least one fixing element S (e.g., a screw) can be locked into the post 213 through at least one of the corresponding front and rear assembly holes 2111 and 2122, thereby connecting the front cover 211 and the rear cover 212 together. However, the present disclosure is not limited thereto, and in certain embodiments, the structure, appearance, and/or the number of components, of the main body 21 can be adjusted by a manufacturer according to product requirements, and the main body 21 can include more or less than two components (for example, more or less than components including the front cover 211 and the rear cover 212).

Referring to FIG. 3 and FIG. 4, in which the cigar cutter 2 is shown as having two cutting blade units 23, each cutting blade unit 23 can be movably mounted to the main body 21 and at least includes a blade holder 231 and a blade 232. One side (e.g., the blade holder 231) of each cutting blade unit 23 is configured to be exposed from the main body 21. The other side (e.g., the blade 232) of each cutting blade unit 23 is configured to extend into the main body 21. Each cutting blade unit 23 further has a position-limiting post 233 (e.g., being disposed on the blade 232). In certain embodiments, the position-limiting post 233 is disposed on the corresponding blade 232 at a position adjacent to one side of the corresponding blade 232, and a through hole 2320 is formed at the blade 232 at a position adjacent to the opposite side of the blade 232. Each through hole 2320 allows passage of a post 213, and each blade 232 can be pivotally connected with the corresponding post 213 such that the corresponding cutting blade unit 23 can be movably mounted to the main body 21 through the corresponding post 213 and be rotated about an axis defined by the corresponding post 213. In certain embodiments, the cigar cutter 2 includes two structurally identical cutting blade units 23 but is not necessarily so configured. In certain embodiments, the main body 21 can be directly provided therein with a stationary cutting blade unit, with the stationary cutting blade unit corresponding in position to the blade 232 of a cutting blade unit 23 so that the cutting blade unit 23 is moved toward the stationary cutting blade unit when moved inward of the main body 21.

Referring to FIG. 3, two identical rotatable rings 24 are shown by way of example only. Each rotatable ring 24 can be movably located in the main body 21, is configured to rotate about a central axis of itself with respect to the main body 21, and is formed with a second through hole 240 and at least one first position-limiting track 241. The second through hole 240 corresponds to the first through hole 210, and the position-limiting post 233 matches the corresponding first position-limiting track 241 so as to be slidable in the corresponding first position-limiting track 241. The positioning ring 25 can be fixed in the main body 21, cannot be rotated with respect to the main body 21, is formed with a third through hole 250 corresponding to the first through hole 210, and is provided with at least one second position-limiting track 251. The position-limiting post 233 of the cutting blade unit 23 matches the corresponding second position-limiting track 251 so as to be slidable in the corresponding second position-limiting track 251. In certain embodiments, the positioning ring 25 forms at least one passage-allowing space 253 corresponding in position to the at least one post 213 so that the at least one post 213 can pass through, and be exposed from the two opposite sides of, the positioning ring 25. The position-limiting post 233 of the cutting blade unit 23 is configured to extend into, and slide in, the corresponding first position-limiting track 241 and the corresponding second position-limiting track 251.

Figure 8:
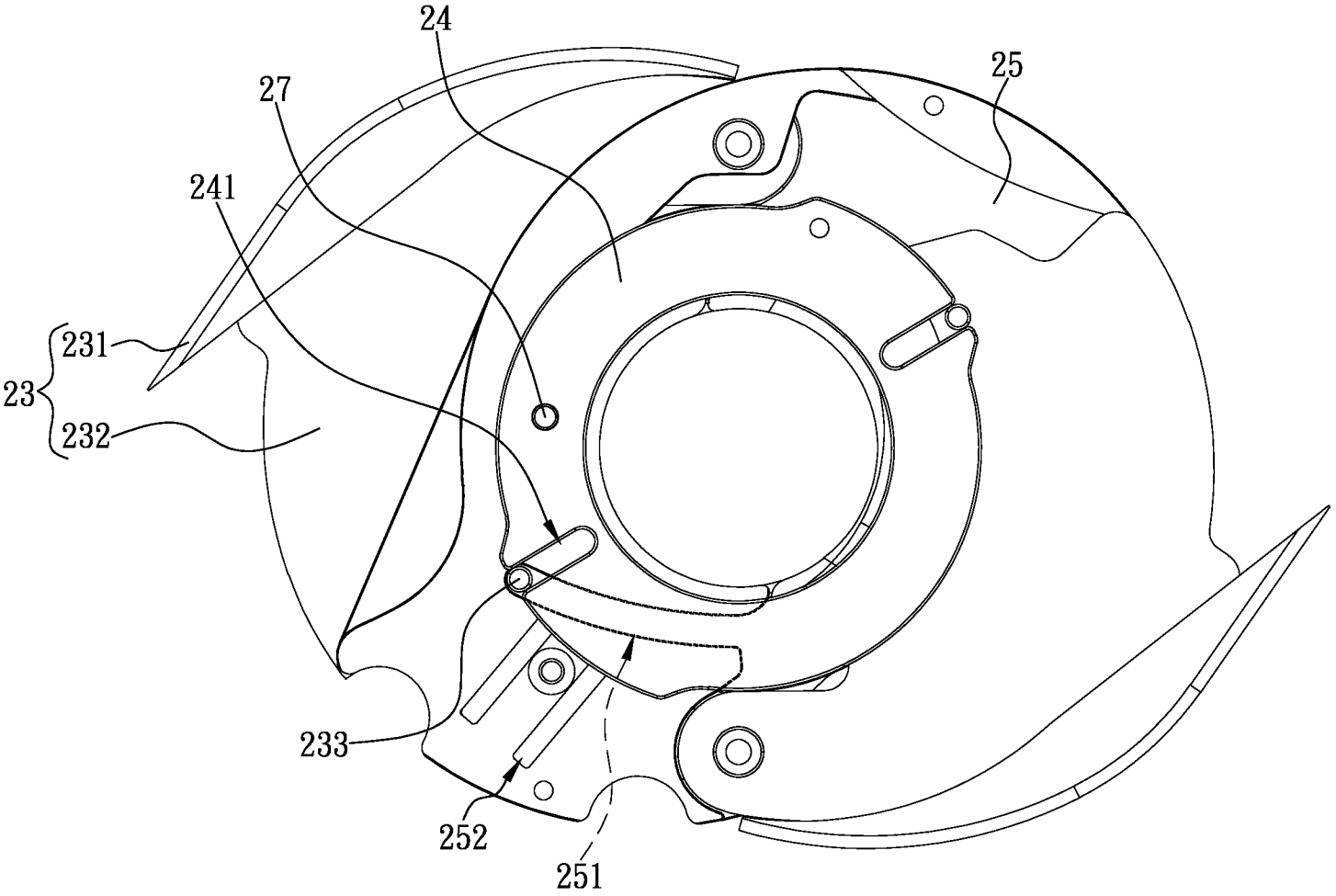
FIG. 8 is a schematic diagram of a position-limiting post being located at a first end of a first position-limiting track and a first end of a second position-limiting track according to certain embodiments of the present disclosure.

In certain embodiment, as shown in FIG. 8, the position of at least one portion of the first position-limiting track 241 superposes on the position of at least one portion of the corresponding second position-limiting track 251. When the position-limiting post 233 is moved, since the positioning ring 25 is fixed in the main body 21, the position-limiting post 233 can only move in and along the corresponding second position-limiting track 251, and since the rotatable ring 24 is movably located in the main body 21, the position-limiting post 233 not only moves in and along the corresponding first position-limiting track 241, but also pushes the inner wall of the corresponding first position-limiting track 241 simultaneously such that the rotatable ring 24 is rotated about the central axis of itself with respect to the main body 21.

Figure 7:
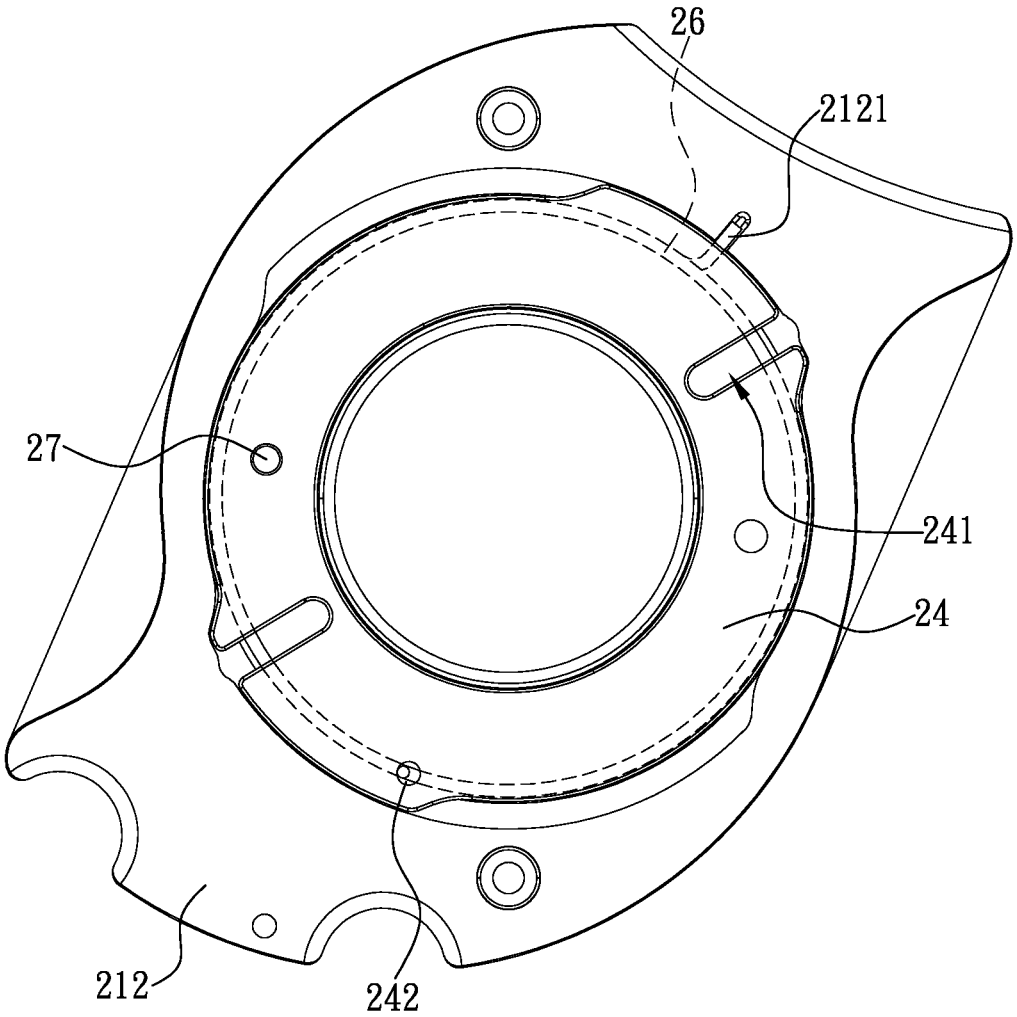
FIG. 7 is a schematic diagram of the assembly of an elastic element with a main body and a rotatable ring according to certain embodiments of the present disclosure.

Referring to FIG. 3 and FIG. 7, the elastic element 26 (for example, a volute spring, a torsion spring, etc.) can be located in the main body 21, has one end (hereinafter referred to as the first end) configured to be fixed to the first positioning portion 2121 of the main body 21. For example, the first end of the elastic element 26 can extend into and be engaged in the first positioning portion 2121 (e.g., a slit). The other end (hereinafter referred to as the second end) of the elastic element 26 can be fixed to a second positioning portion 242 (e.g., an aperture) of the rotatable ring 24. For example, the second end of the elastic element 26 can extend into the aperture. However, the present disclosure is not limited thereto, and in certain embodiments, the first positioning portion 2121, the second positioning portion 242, and the two ends of the elastic element 26 can be adjusted in configuration as long as the foregoing connection relationships can be formed. When a cigar cutter 2 includes two rotatable rings 24, the second end of the elastic element 26 can be fixed to the second positioning portion 242 of only one of the rotatable rings 24.

Figure 9:
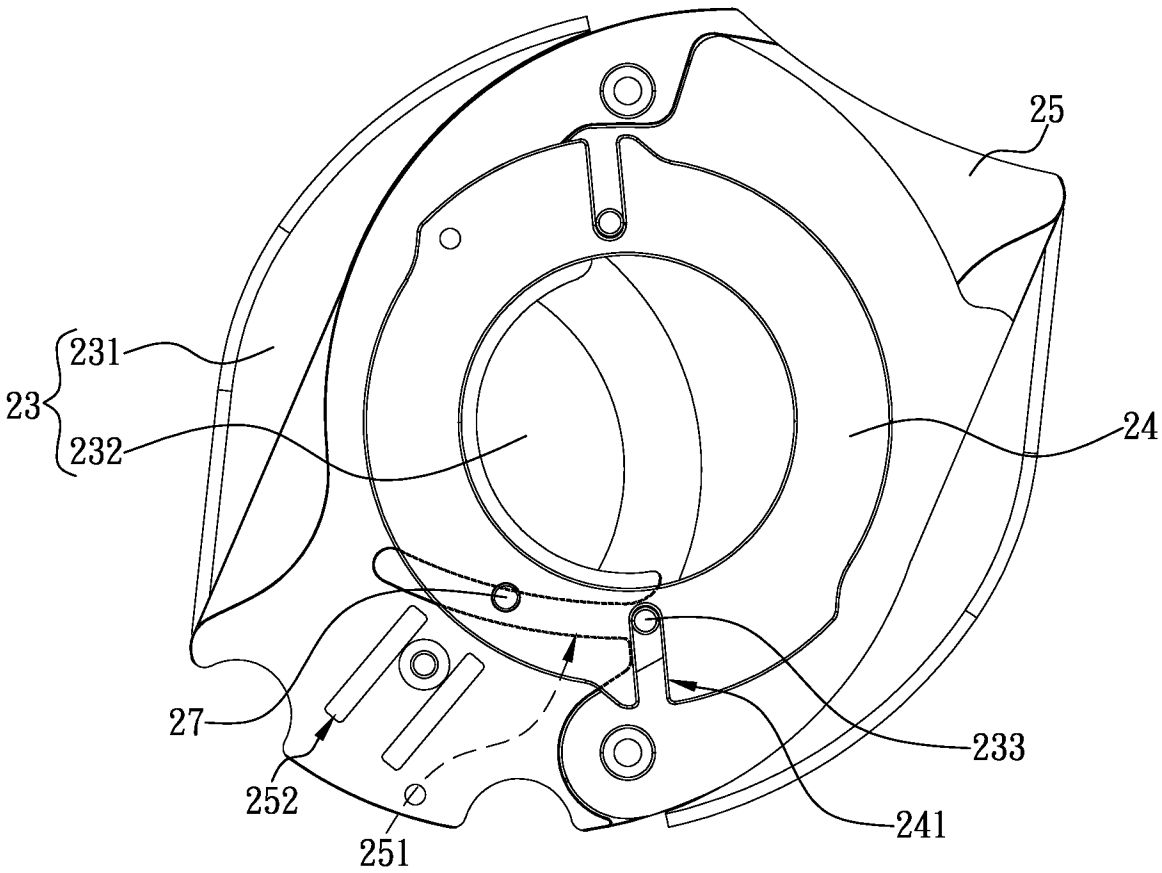
FIG. 9 is a schematic diagram of the position-limiting post being located at a second end of the first position-limiting track and a second end of the second position-limiting track according to certain embodiments of the present disclosure.

In certain embodiments, referring to FIG. 3, FIG. 5 and FIG. 7, when at least one cutting blade unit 23 is pressed by a user and thus displaced inward of the main body 21, the position-limiting post 233 slides from a first end of the corresponding first position-limiting track 241 (see FIG. 8) toward a second end of the corresponding first position-limiting track 241 (see FIG. 9), and from a first end of the corresponding second position-limiting track 251 (see FIG. 8) toward a second end of the corresponding second position-limiting track 251 (see FIG. 9), and pushes the rotatable ring 24 to rotate. During this rotating process, the rotatable ring 24 simultaneously drives the elastic element 26 such that the elastic element 26 is compressed and stores a restoring force to the extent that the cutting blade unit(s) 23 covers the first through hole 210, the second through hole 240, and the third through hole 250, i.e., until the cigar cutter 2 enters the closed state (see FIG. 5). When the cutting blade unit(s) 23 is no longer pressed, the restoring force of the elastic element 26 drives the rotatable ring 24 to rotate reversely. During the reverse rotation, the rotatable ring 24 pushes each position-limiting post 233 such that each position-limiting post 233 slides from the second ends (see FIG. 9) toward the first ends (see FIG. 8) of the corresponding first position-limiting track 241 and second position-limiting track 251 until the cutting blade unit(s) 23 no longer cover the first through hole 210, the second through hole 240, or the third through hole 250, i.e., until the cigar cutter 2 enters into the open state (see FIG. 4). It is noted that the reference of "the cutting blade unit(s) 23 covers the first through hole 210, the second through hole 240, and the third through hole 250" supra is defined as at least one portion of a cigar being unable to pass through any of the first through hole 210, the second through hole 240 and the third through hole 250, and accordingly the cutting blade unit(s) 23 being unable to cut the cigar or cut a groove in the cigar; and the reference of "the cutting blade unit(s) 23 no longer covers the first through hole 210, the second through hole 240, or the third through hole 250" supra is defined as the first through hole 210, the second through hole 240, and the third through hole 250 being in a state allowing passage of at least one portion of a cigar, and accordingly the cutting blade unit(s) 23 being able to cut the cigar or cut a groove in the cigar. In other words, the cigar cutter 2 cannot be used to cut a cigar when in the closed state, and can be used to cut a cigar when in the open state.

Figure 10:
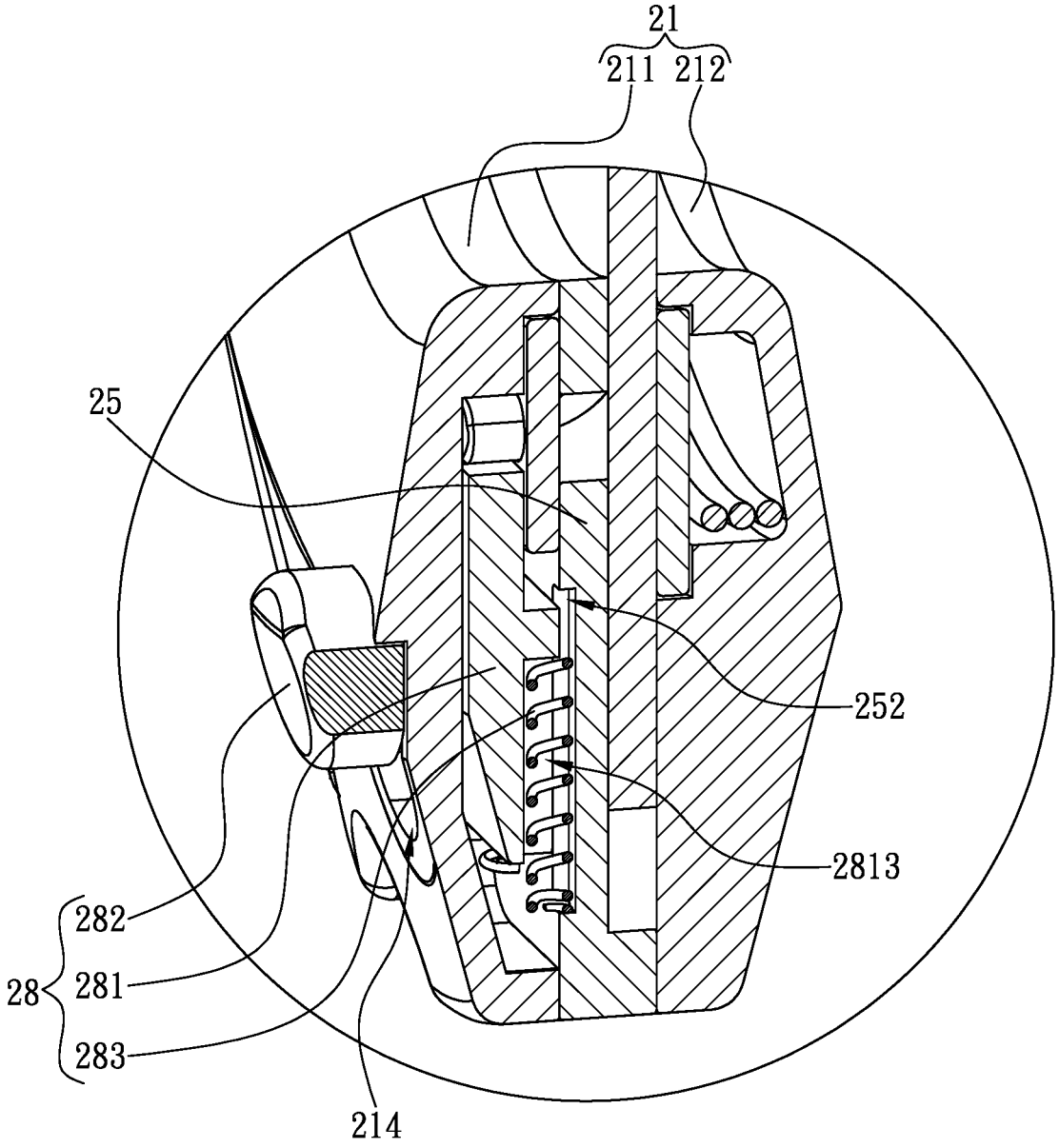
FIG. 10 is a schematic diagram showing a partial cross-section of a cigar cutter including a locking assembly according to certain embodiments of the present disclosure.
Figure 11A:
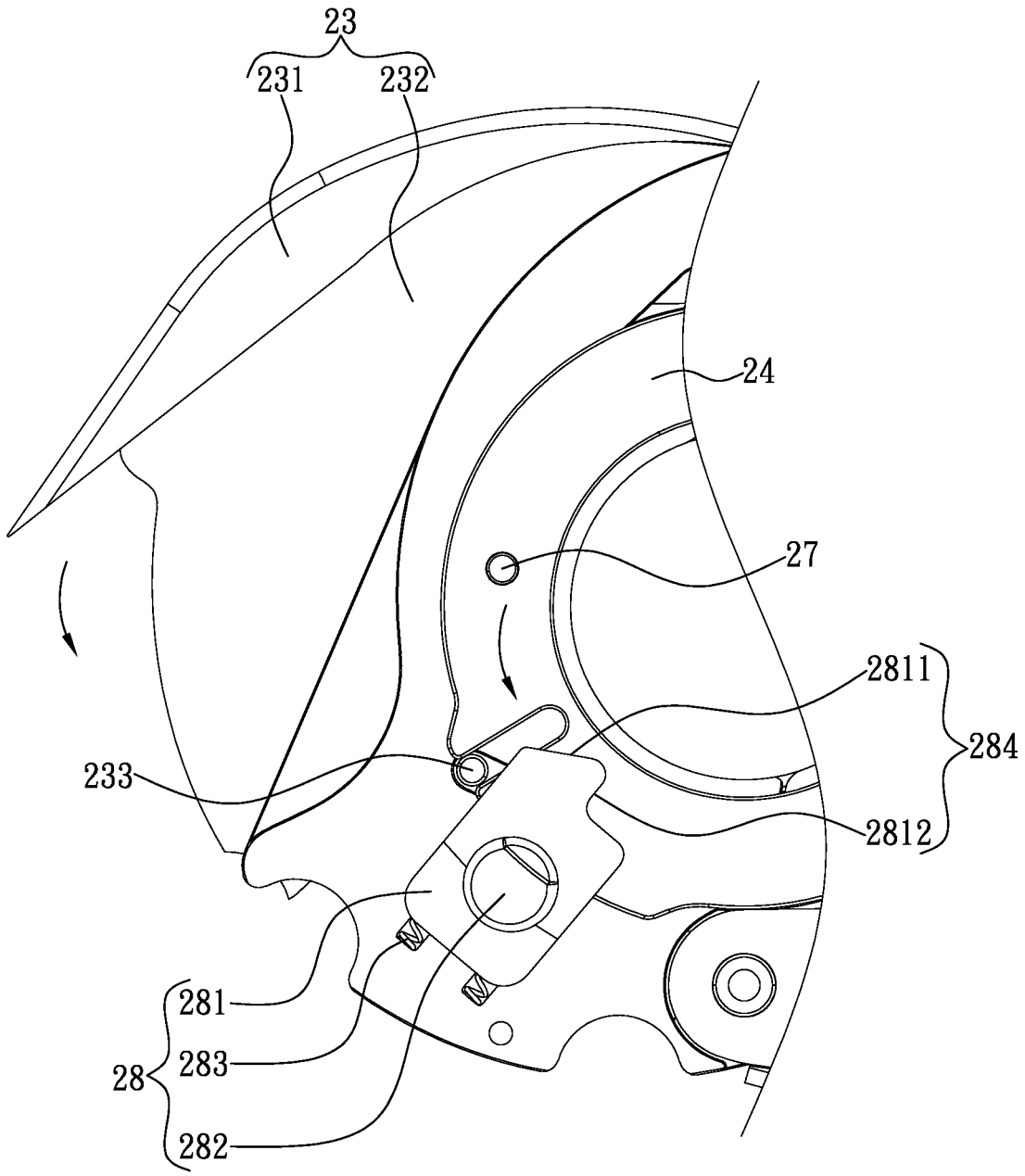
FIGS. 11A-11E are schematic diagrams showing the process of a locking assembly and an arresting portion when a cigar cutter enters a closed state from an open state according to certain embodiments of the present disclosure.

Referring to FIG. 3, FIG. 10, and FIG. 11A, the locking assembly 28 can be mounted to the main body 21, and the locking assembly 28 includes a plate 281, an operation key 282, and at least one elastic member 283. The plate 281 can be located in the main body 21 and have an engaging portion 284 at one end (e.g., at the upper right corner of the plate 281 shown in FIG. 11A). In certain embodiments, the engaging portion 284 has an inclined surface 2811 and a shoulder portion 2812, and the shoulder portion 2812 is adjacent to one side of the inclined surface 2811. For example, referring to FIG. 11A, the shoulder portion 2812 can be located to the right of the inclined surface 2811. The operation key 282 can be fixed on the front side of the plate 281 and exposed through the slide hole 214. A portion of the operation key 282 occupies a part of the slide hole 214, has a length that is smaller than the length of the slide hole 214 (see FIG. 10), and can therefore be displaced in the slide hole 214 to drive the plate 281 to move back and forth. For example, referring to FIG. 11A, the plate 281 can be driven back and forth in an upper-right-to-lower-left and lower-left-to-upper-right direction by the operation key 282.

With continued reference to FIG. 3, FIG. 10, and FIG. 11A, the elastic member 283 can be located in the main body 21 and is configured to apply a force to the plate 281 and drive one end of the plate 281 to move along a direction towards the first through hole 210 through the force. In certain embodiments, the positioning ring 25 is formed with at least one first receiving groove 252, and the plate 281 is formed with at least one second receiving groove 2813. The first receiving groove 252 and the second receiving groove 2813 jointly receive the elastic member 283. The elastic member 283 can press against the wall of the first receiving groove 252 and the wall of the second receiving groove 2813, respectively, and thereby apply the aforesaid force to the plate 281. However, the present disclosure is not limited thereto, and in certain embodiments, the elastic member 283 is not necessarily disposed on, or only on, the positioning ring 25, but to any position that allows the elastic member 283 to push the plate 281 so that plate 281 moves towards the first through hole 210.

Figure 11B:
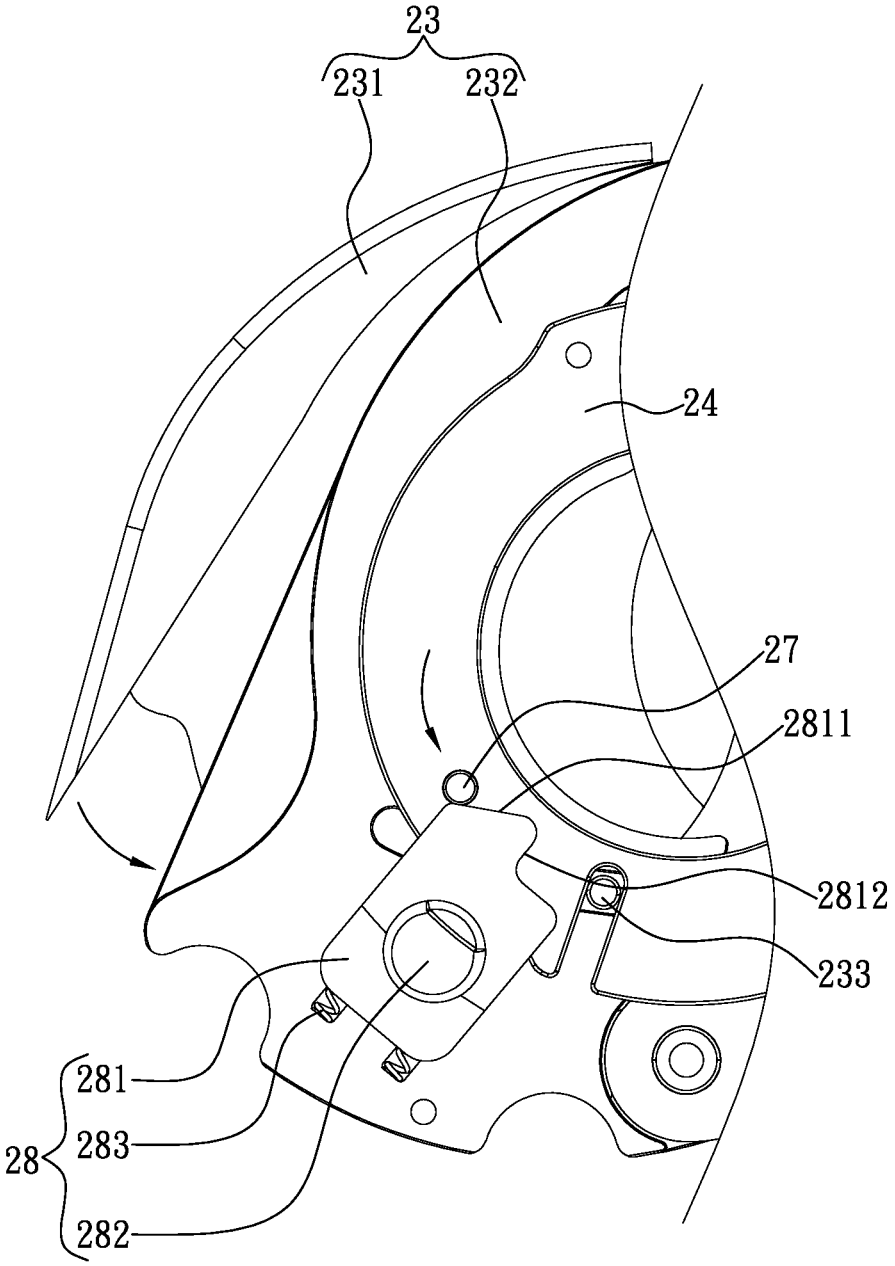
Figure 11C:
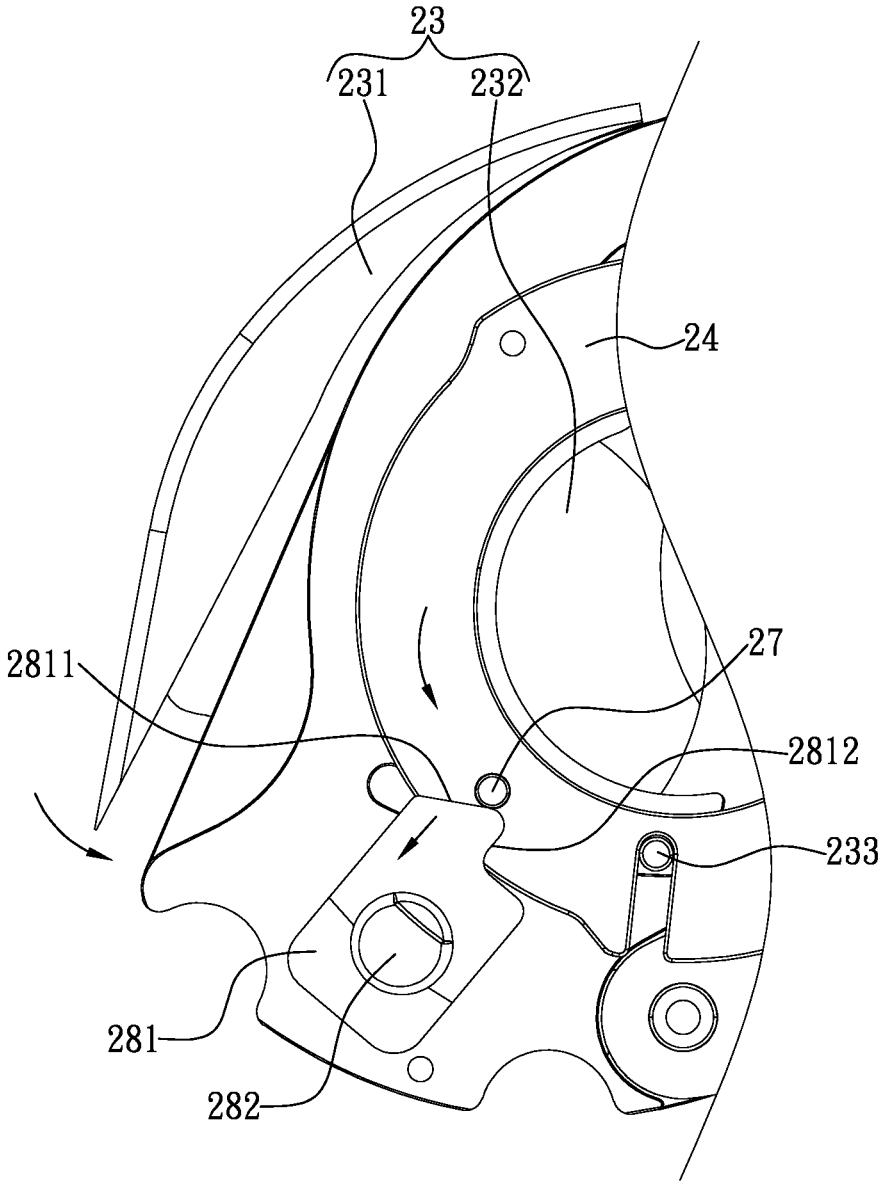

In certain embodiments, with continued reference to FIG. 3, the arresting portion 27 is fixed on the rotatable ring 24, is formed as a post, and can be driven and displaced by the rotatable ring 24. However, the present disclosure is not limited thereto, and in certain embodiments, the arresting portion 27 can be an independent element or an extending portion of another element (e.g., the elastic element 26), as long as the arresting portion 27 can be displaced together with the rotatable ring 24 when the rotatable ring 24 is rotated. The working process of the locking assembly 28 and the arresting portion 27 and how the cigar cutter 2 stays in the closed state are further described infra. Referring to FIG. 11A, in which the cigar cutter 1 is in the open state, the arresting portion 27 is located at a position that is closer to a first side of than to a second side of the inclined surface 2811 that is opposite to the first side, for example, at a position closer to the left side than to the right side of the inclined surface 2811 as shown in FIG. 11A. When a user starts to press the cutting blade units 23, the cutting blade unit 23 is moved inward, and the position-limiting post 233 on each cutting blade unit 23 pushes the rotatable ring 24 into rotation. As a result, the elastic element 26 is compressed, and the arresting portion 27 is gradually moved toward the first side of the inclined surface 2811 until pressed against the first side of the inclined surface 2811 (as shown in FIG. 11B). As the rotatable ring 24 continues rotating, the arresting portion 27 is moved from the first side toward the second side of the inclined surface 2811 (for example, from the left side toward the right side of the inclined surface 2811 as shown in FIG. 11C, and during the moving process, the plate 281 is pushed by the arresting portion 27 and accordingly moves away from the first through hole 210, thereby compressing the elastic member 283.

Figure 11D:
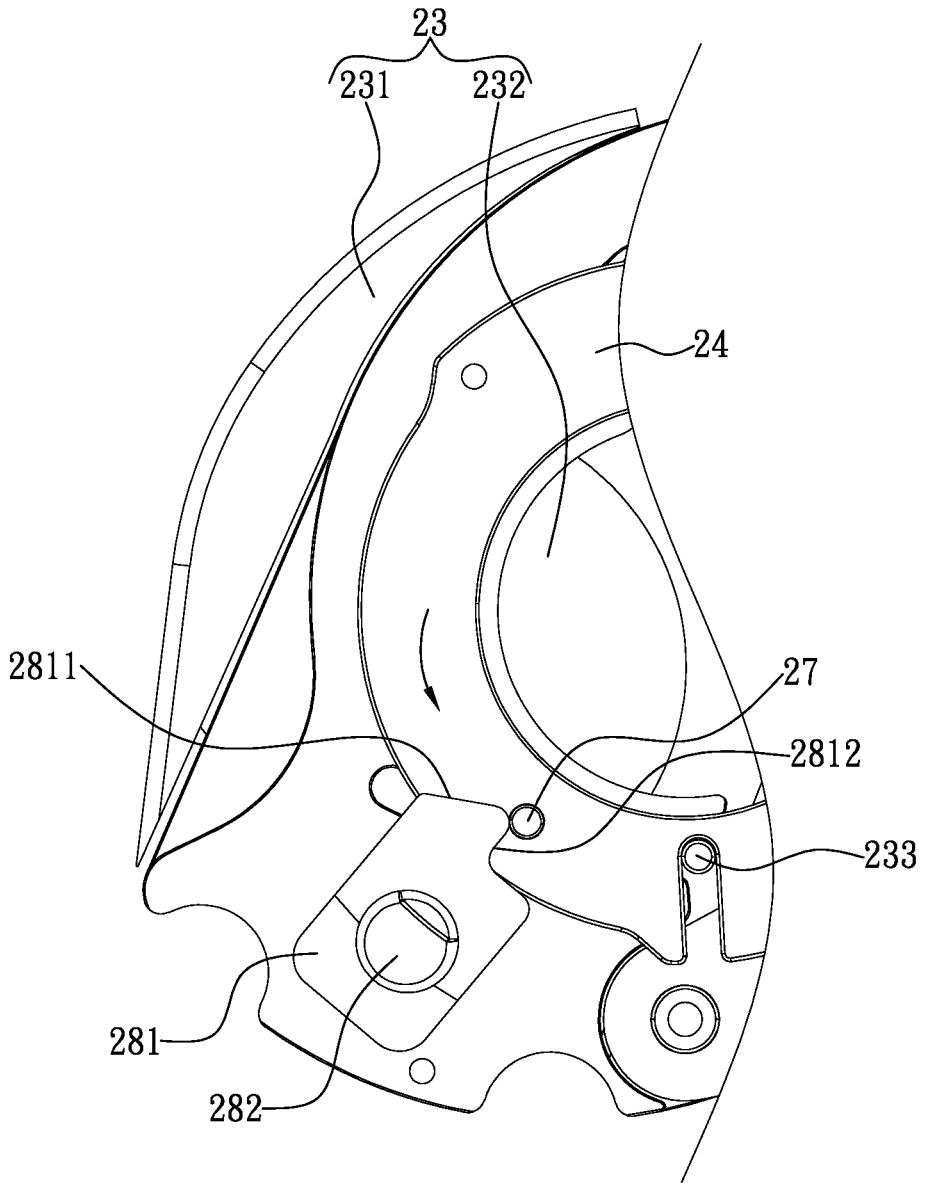
Figure 11E:
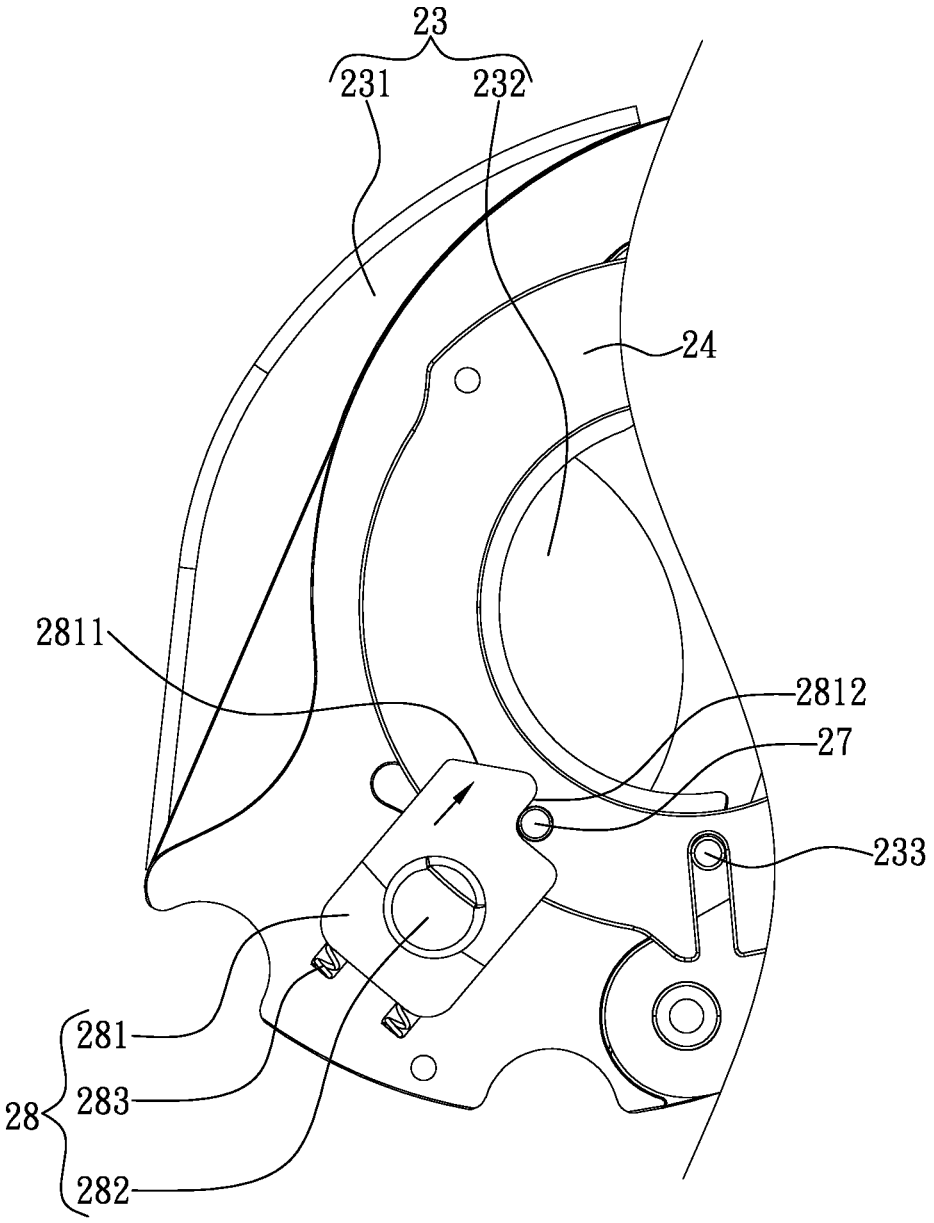

With continued reference to FIG. 3, once the arresting portion 27 moves past the inclined surface 2811 (as shown in FIG. 11D), the plate 281 is no longer pushed by the arresting portion 27 and is therefore moved toward the first through hole 210 by the force stored in the elastic member 283 (as indicated by the arrow on the plate 281 in FIG. 11E), with the arresting portion 27 being located at a position corresponding to the shoulder portion 2812. When the cutting blade unit(s) 23 is no long pressed (for example, when the user releases fingers), the rotatable ring 24 is driven into reverse rotation by the force of the elastic element 26, and the cutting blade unit(s) 23 is pushed and consequently moved by the rotatable ring 24 such that the arresting portion 27 is pressed tightly against the shoulder portion 2812 (as shown in FIG. 11E) to keep the cigar cutter 2 secure in the closed state.

Figure 12A:
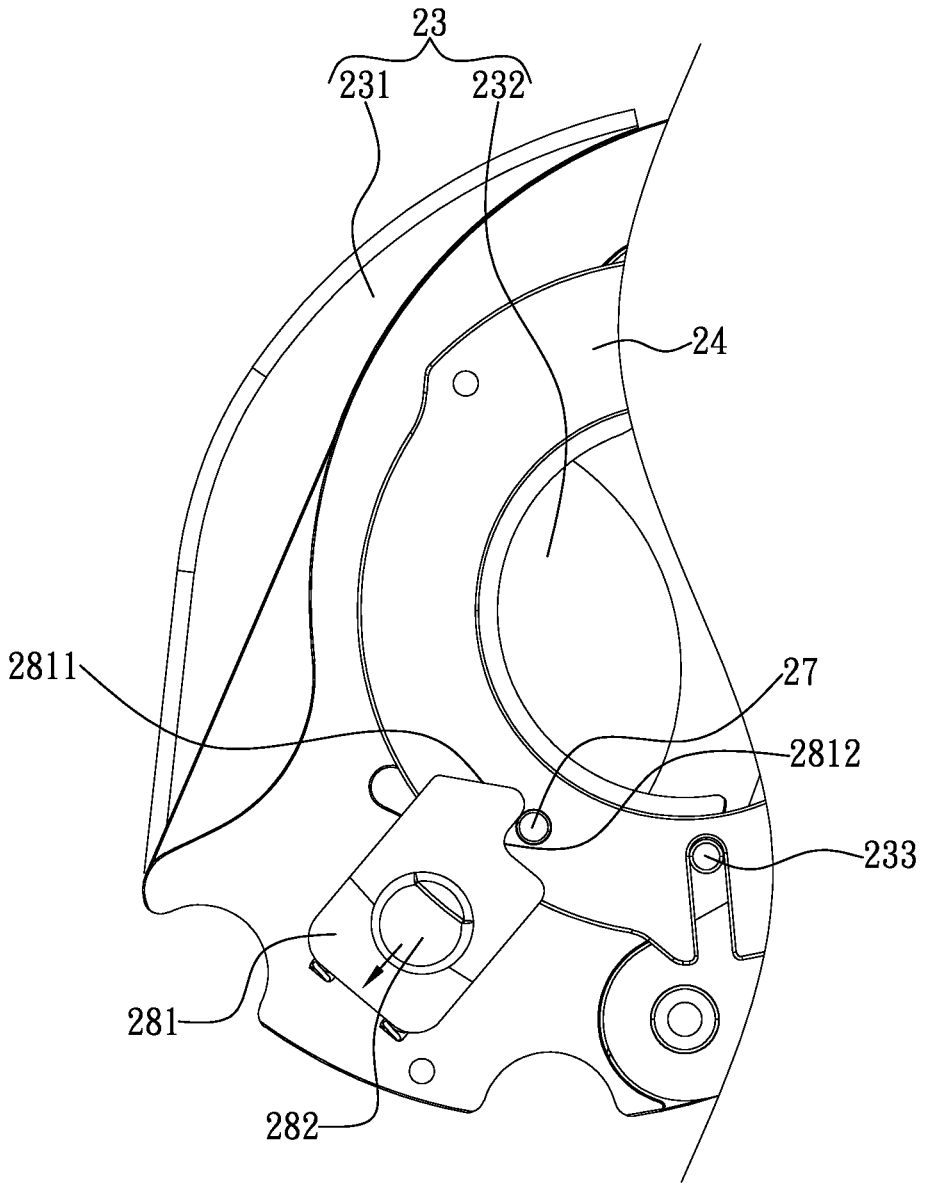
FIGS. 12A and 12B are schematic diagrams showing the process of a locking assembly and an arresting portion when a cigar cutter enters an open state from a closed state according to certain embodiments of the present disclosure.
Figure 12B:
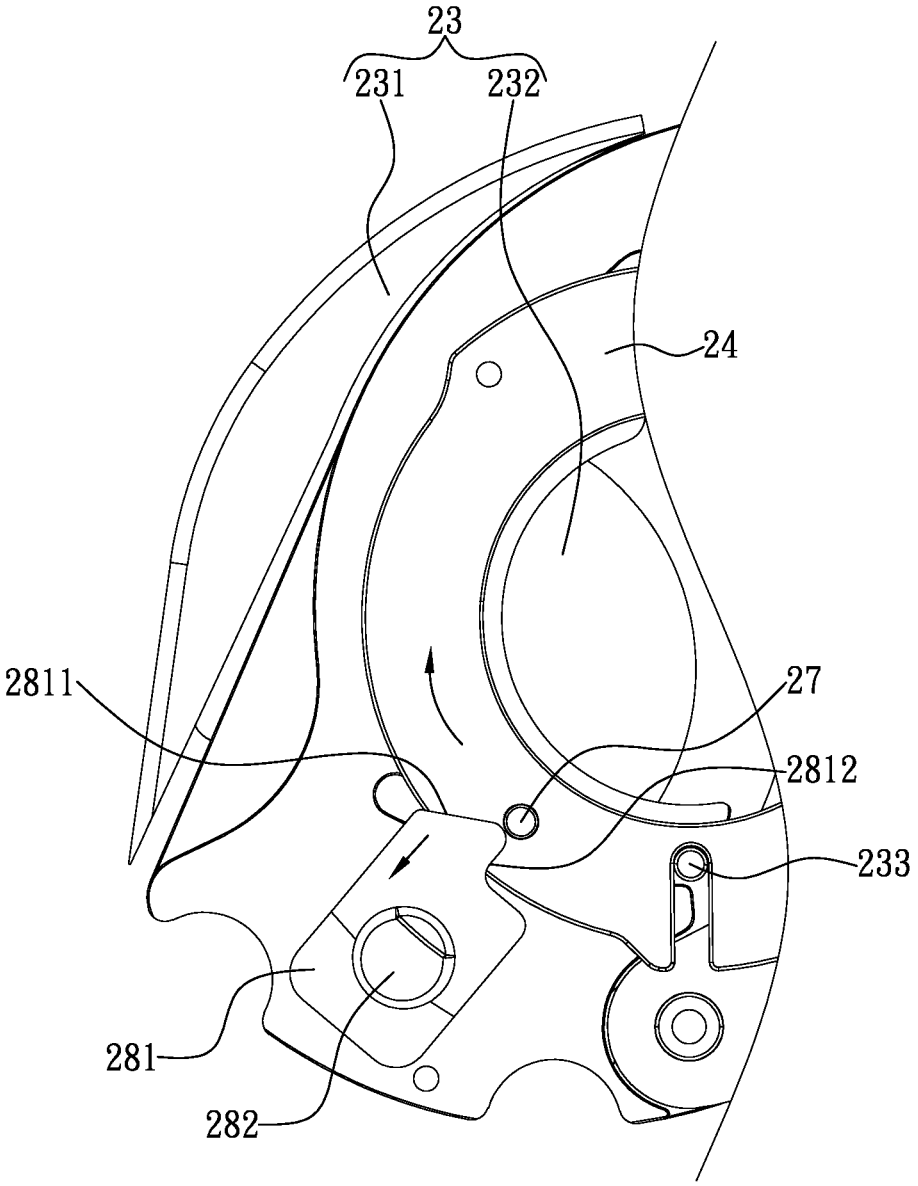

When the user wishes to use the cigar cutter 2, referring to FIG. 12A in conjunction with FIG. 3, the user needs only to push the operation key 282 outward (for example, moving the operation key 282 in the direction indicated by the arrow in FIG. 12A). The operation key 282 will move the plate 281 away from the first through hole 210. Once the arresting portion 27 is no longer blocked by the shoulder portion 2812 (as shown in FIG. 12B), the rotatable ring 24 will be driven to rotate reversely by the force of the elastic element 26 such that each position-limiting post 233 is slid from the second ends toward the first ends of the corresponding first position-limiting track 241 and of the corresponding second position-limiting track 251, thereby driving the cigar cutter 2 into the open state, and the arresting portion 27 will move past the inclined surface 2811 again to a position on the first side as shown in FIG. 11A of the inclined surface 2811. It can be known from the above that the position-limiting posts 233, the rotatable ring 24, the elastic element 26, the arresting portion 27, and the locking assembly 28 according to the present disclosure allow a user to switch the cigar cutter 2 between the closed state and the open state simply by pressing the cutting blade unit(s) 23 and pushing the operation key 282. Accordingly, after using the cigar cutter 2, the user can easily keep the cigar cutter 2 in the closed state and store the cigar cutter 2 in a pocket or bag. The convenience and safety of use of the cigar cutter 2 are thus greatly enhanced in comparison with the prior art.

Figure 13A:
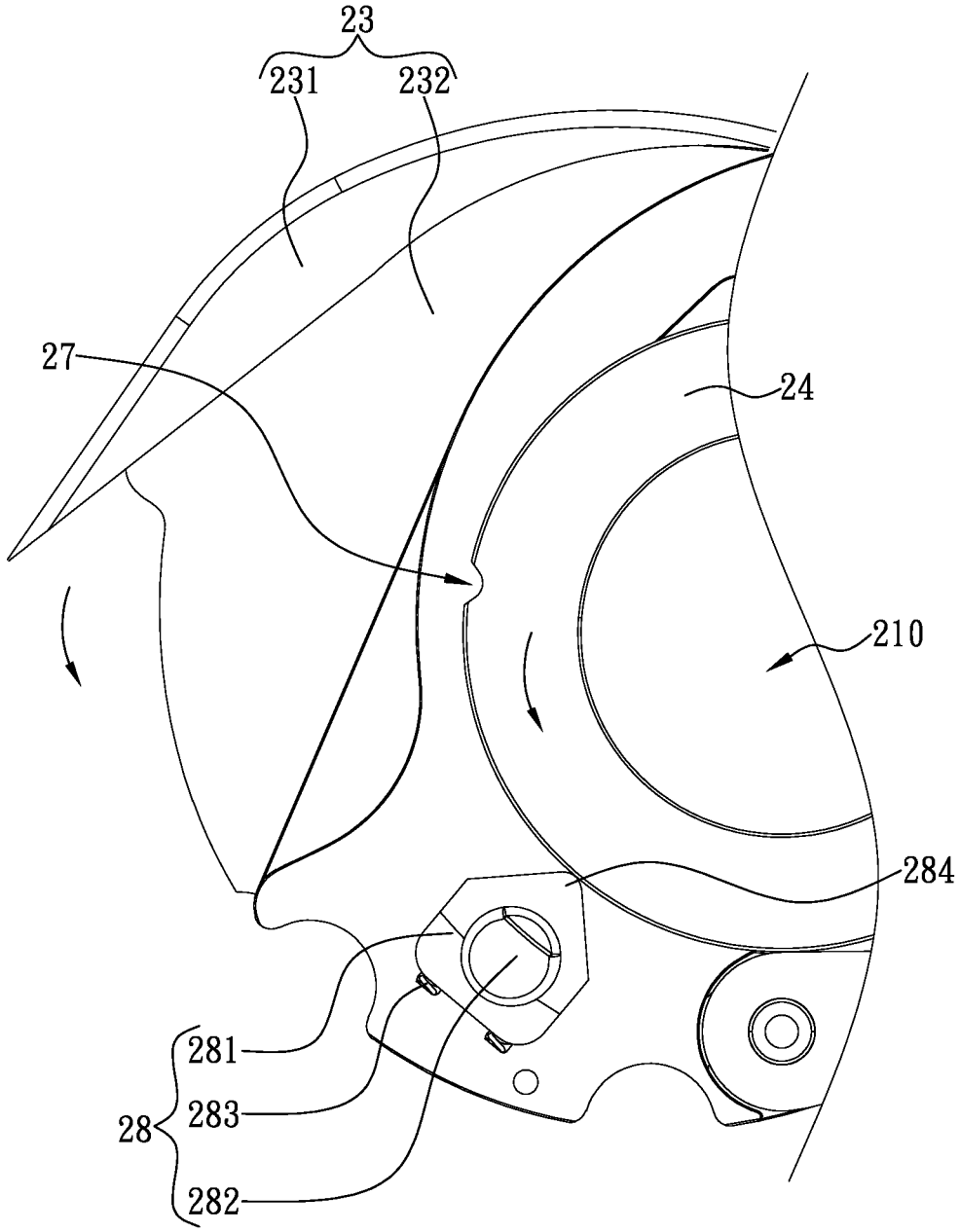
FIGS. 13A and 13B are schematic diagrams showing the process of a locking assembly and an arresting portion when a cigar cutter enters a closed state from an open state according to certain embodiments of the present disclosure.
Figure 13B:
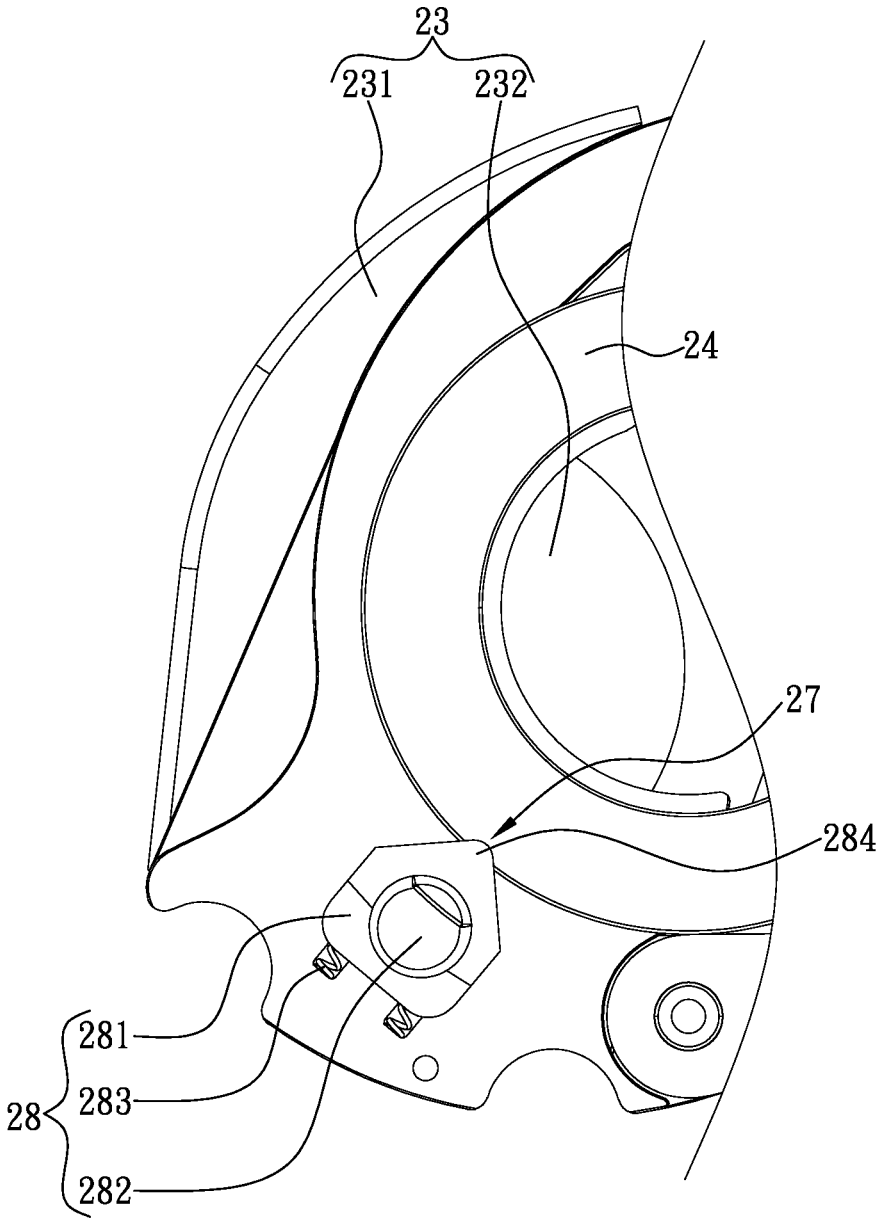

The elements of the mechanism by which the cutting blade unit(s) 23 drives the rotatable ring 24 can be adjusted in position according to practical needs. For the sake of brevity, only the working relationships of certain elements shown in FIG. 13A and FIG. 13B are described below. In certain embodiments, the arresting portion 27 is formed as a notch and is located at an edge of the rotatable ring 24. In other words, the arresting portion 27 extends inward (i.e., toward the first through hole 210) from the edge of the rotatable ring 24. One end of the plate 281 (e.g., at the upper right corner of the plate 281 shown in FIG. 13A) has the engaging portion 284, and the engaging portion 284 has a protruding shape (e.g., a substantially triangular shape as shown in FIG. 13A). When the cigar cutter 2 is in the open state (as shown in FIG. 4), the engaging portion 284 is pressed against the edge of the rotatable ring 24 but does not correspond in position to the arresting portion 27. When a user starts to press the cutting blade unit(s) 23, thereby driving the rotatable ring 24 into rotation and compressing the elastic element 26, the arresting portion 27 is gradually moved toward the engaging portion 284. Once the arresting portion 27 corresponds in position to the engaging portion 284, the plate 281 is moved by the force stored in the elastic member 283 such that the engaging portion 284 extends into the arresting portion 27. When the cutting blade unit(s) 23 is no longer pressed (i.e., when the user releases fingers), the rotatable ring 24 is driven to rotate reversely by the force of the elastic element 26, and the cutting blade unit(s) 23 is pushed and consequently moved by the rotatable ring 24, so that the engaging portion 284 and the arresting portion 27 abut against each other tightly and the cigar cutter is securely kept in the closed state.

When the user wishes to use the cigar cutter 2, referring to FIG. 13B in conjunction with FIG. 3, the user needs only to push the operation key 282 outward. The operation key 282 will move the plate 281 along a direction away from the arresting portion 27, and once the arresting portion 27 is no longer retained by the engaging portion 284 (as shown in FIG. 13A), the rotatable ring 24 will be driven to rotate reversely by the force of the elastic element 26 such that the arresting portion 27 is moved back to a position that does not correspond to the engaging portion 284, and the cigar cutter 2 enters the open state.

Figure 14A:
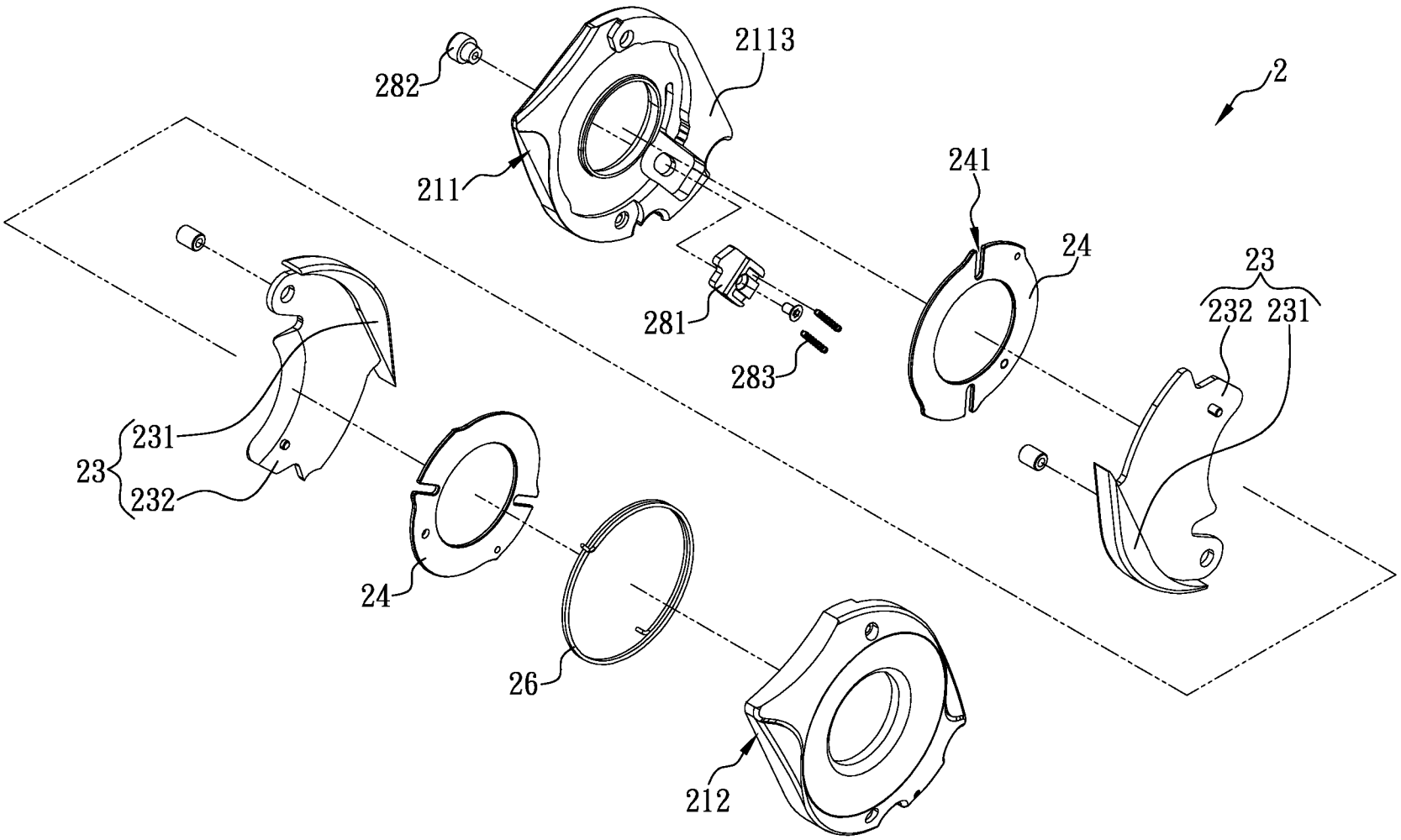
FIG. 14A is a rear exploded view of a cigar cutter according to certain embodiments of the present disclosure.
Figure 14B:
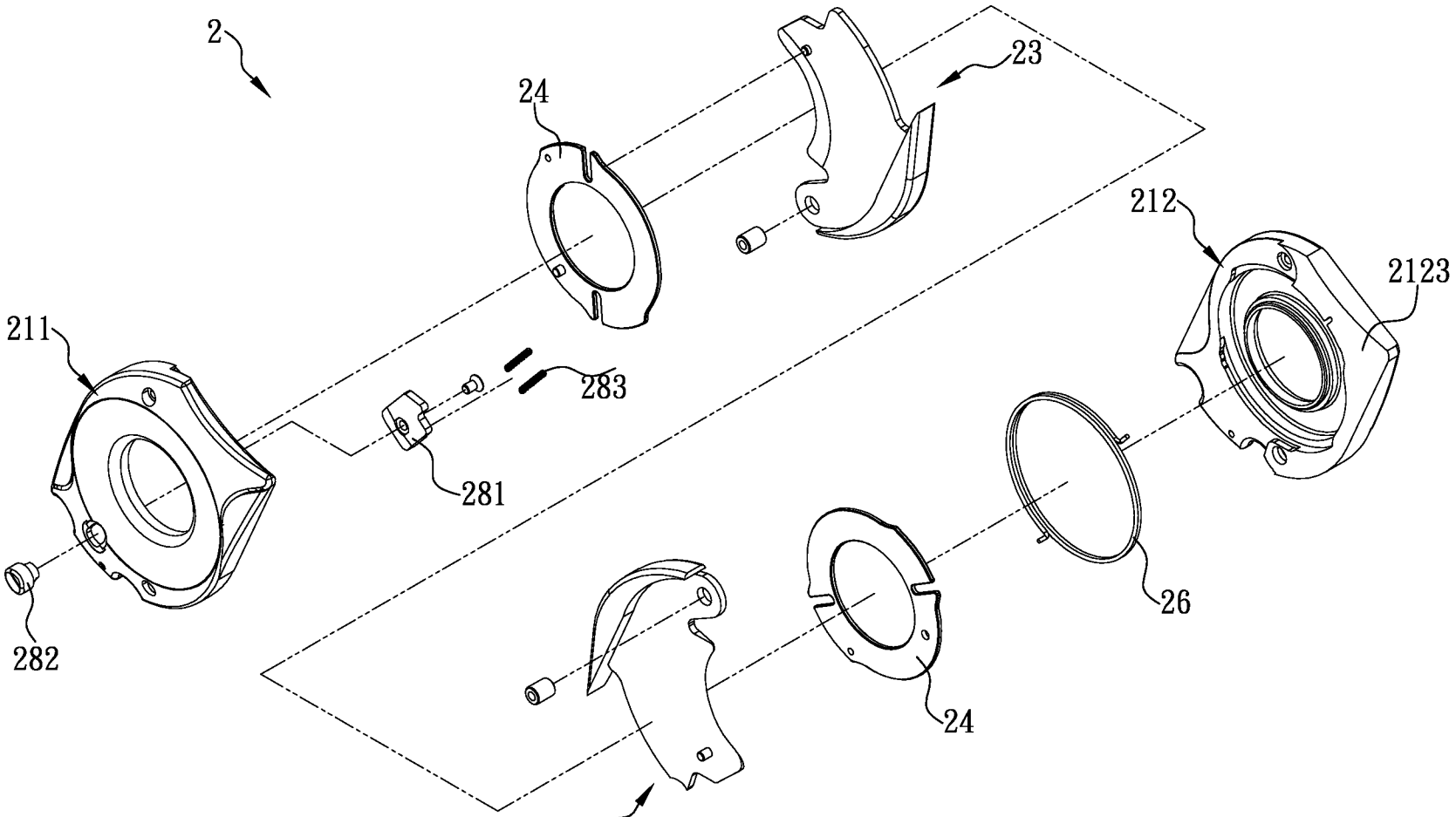
FIG. 14B is a front exploded view of a cigar cutter according to certain embodiments of the present disclosure.

In certain embodiments, the positioning ring 25 can be omitted from the cigar cutter 2 while retaining the functions of the afore-referenced closed state and open state of the cigar cutter 2. Referring to FIGS. 14A and 14B, for the cutting blade units 23 to move in a smoother fashion without tilting, an area of the rear side of the front cover 211 (for example, an area that accounts for a half of the rear side and closer to the right side of FIG. 14A, while the present disclosure is not limited thereto) can have a front protruding block 2113, and an area of the front side of the rear cover 212 (for example, an area that accounts for a half of the front side and closer to the right side of FIG. 14B) can have a rear protruding block 2123. When the front cover 211 and the rear cover 212 are assembled with each other, the front protruding block 2113 and the rear protruding block 2123 are not aligned with each other and do not correspond in position to each other. For example, when the front protruding portion 2113 is located at a position at the left side of the front cover 211, the rear protruding portion 2123 is located at a position at the right side of the rear cover 212. In certain embodiments, a protruding thickness degree of the front protruding block 2113 and a protruding thickness degree of the rear protruding block 2123 are the same or substantially the same. The protruding thickness degree of the front protruding block 2113 is defined as a vertical distance of the front protruding block 2113 extending rearwards with respect to a location on the rear side of the front cover 211 that is different from that of the front protruding block 2113. The protruding thickness degree of the rear protruding block 2123 is defined as a vertical distance of the rear protruding block 2123 extending frontwards with respect to a location on the front side of the rear cover 212 that is different from that of the rear protruding block 2123.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A cigar cutter, comprising:

a main body formed with a first through hole and a slide hole that is nearer to an edge of the main body than the first through hole is;

a rotatable ring configured to be movably located in the main body, and formed with at least one first position-limiting track and a second through hole that corresponds to the first through hole;

an elastic element configured to be located in the main body, and having one end configured to be fixed to a first positioning portion of the main body, and another end configured to be fixed to a second positioning portion of the rotatable ring;

at least one cutting blade unit configured to be movably mounted to the main body, having one side configured to be exposed from the main body and the other side configured to extend into the main body, and having a position-limiting post, wherein the elastic element is configured to be compressed when the at least one cutting blade unit is displaced along a direction towards the main body, and to push the at least one cutting blade unit away from the main body and drive the rotatable ring to rotate reversely so that the cigar cutter enters an open state, the at least one first position-limiting track is configured to allow the position-limiting post to extend and slide therein, and the position-limiting post is configured to:

when the at least one cutting blade unit is moved along the direction towards the main body, slide from a first end of the at least one first position-limiting track towards a second end of the at least one first position-limiting track and push the rotatable ring to rotate so as to compress the elastic element until the cigar cutter enters a closed state, wherein the at least one cutting blade unit covers the first through hole and the second through hole in the closed state; and when the at least one cutting blade unit is driven by the elastic element to move along a direction away from the main body, slide from the second end of the at least one first position-limiting track towards the first end of the at least one first position-limiting track through reverse rotation of the rotatable ring driven by the elastic element, so that the at least one cutting blade unit enters the open state, wherein the first through hole and the second through hole are not covered by the at least one cutting blade unit in the open state;

a locking assembly configured to be mounted to the main body and comprising:

a plate configured to be located in the main body and having an engaging portion at one end;

an operation key configured to be fixed on the plate, exposed through the slide hole, and displaced in the slide hole to drive the plate to move back and forth; and at least one elastic member configured to be located in the main body, apply a force to the plate, and drive one end of the plate to move along a direction towards the first through hole through the force; and an arresting portion configured to:

be displaced together with the rotatable ring when the rotatable ring is rotated;

when the cigar cutter is in the open state, not correspond in position to the engaging portion;

when the at least one cutting blade unit is pressed and the elastic element is compressed, move along a direction towards the engaging portion until corresponding in position to the engaging portion; and when the at least one cutting blade unit is not pressed and the rotatable ring is driven to rotate reversely by a restoring force of the elastic element to push the at least one cutting blade unit to move, press against the engaging portion to keep the cigar cutter in the closed state.

2. The cigar cutter according to claim 1, wherein the operation key is configured to, when the cigar cutter is in the closed state, move the plate away from the first through hole; the elastic element is configured to, once the arresting portion stops being blocked by the engaging portion, drive the rotatable ring to rotate reversely; and the rotatable ring is configured to rotate reversely to drive the position-limiting post to slide from the second end of the at least one first position-limiting track toward the first end of the at least one first position-limiting track and to drive the at least one cutting blade unit to stop covering the first and second through holes, so that the cigar cutter enters the open state and the arresting portion is moved to not correspond in position to the engaging portion.

3. The cigar cutter according to claim 1, wherein the main body comprises a front cover formed with a front through hole, and a rear cover formed with a rear through hole, wherein the front through hole and the rear through hole jointly form the first through hole.

4. The cigar cutter according to claim 3, further comprising a positioning ring configured to be located in the main body and formed with a third through hole and at least one second position-limiting track, wherein the third through hole corresponds to the first through hole, and the position-limiting post is configured to:

extend into, and slide in, the at least one first position-limiting track and the at least one second position-limiting track simultaneously;

when the at least one cutting blade unit is moved along the direction towards the main body, slide from a first end of the at least one second position-limiting track towards a second end of the at least one second position-limiting track and push the rotatable ring to rotate until the cigar cutter enters the closed state, wherein the at least one cutting blade unit covers the first through hole, the second through hole and the third through hole in the closed state; and when the elastic element drives the rotatable ring to rotate reversely, slide from the second end of the at least one second position-limiting track towards the first end of the at least one second position-limiting track, so that the at least one cutting blade unit enters the open state, wherein the first through hole, the second through hole and the third through hole are not covered by the at least one cutting blade unit in the open state.

5. The cigar cutter according to claim 4, wherein the positioning ring is formed with at least one first receiving groove, the plate is formed with at least one second receiving groove, the at least one first receiving groove and the at least one second receiving groove are configured to jointly receive the at least one elastic member, and the at least one elastic member is configured to press against a wall of the at least one first receiving groove and a wall of the at least one second receiving groove, respectively.

6. The cigar cutter according to claim 4, wherein a position of at least one portion of the at least one first position-limiting track superposes on a position of at least one portion of the at least one second position-limiting track.

7. The cigar cutter according to claim 3, wherein an area of a rear side of the front cover has a front protruding block, an area of a front side of the rear cover has a rear protruding block, and the front protruding block and the rear protruding block are not aligned with and do not correspond in position to each other when the front cover and the rear cover are assembled with each other.

8. The cigar cutter according to claim 7, wherein a protruding thickness degree of the front protruding block and a protruding thickness degree of the rear protruding block are the same or substantially the same.

9. The cigar cutter according to claim 1, further comprising a positioning ring configured to be located in the main body and formed with a third through hole and at least one second position-limiting track, wherein the third through hole corresponds to the first through hole, and the position-limiting post is configured to:

extend into, and slide in, the at least one first position-limiting track and the at least one second position-limiting track simultaneously;

when the at least one cutting blade unit is moved along the direction towards the main body, slide from a first end of the at least one second position-limiting track towards a second end of the at least one second position-limiting track and push the rotatable ring to rotate until the cigar cutter enters the closed state, wherein the at least one cutting blade unit covers the first through hole, the second through hole and the third through hole in the closed state; and when the elastic element drives the rotatable ring to rotate reversely, slide from the second end of the at least one second position-limiting track towards the first end of the at least one second position-limiting track, so that the at least one cutting blade unit enters the open state, wherein the first through hole, the second through hole and the third through hole are not covered by the at least one cutting blade unit in the open state.

10. The cigar cutter according to claim 9, wherein the positioning ring is formed with at least one first receiving groove, the plate is formed with at least one second receiving groove, the at least one first receiving groove and the at least one second receiving groove are configured to jointly receive the at least one elastic member, and the at least one elastic member is configured to press against a wall of the at least one first receiving groove and a wall of the at least one second receiving groove, respectively.

11. The cigar cutter according to claim 9, wherein a position of at least one portion of the at least one first position-limiting track superposes on a position of at least one portion of the at least one second position-limiting track.

12. The cigar cutter according to claim 1, wherein the engaging portion has an inclined surface and a shoulder portion, the shoulder portion is adjacent to one side of the inclined surface, and the arresting portion is formed as a post and configured to:

when the cigar cutter is in the open state, be located at a position that is closer to a first side of than to a second side of the inclined surface; and when the at least one cutting blade unit is pressed and the elastic element is compressed, move from the first side toward the second side of the inclined surface and push the plate to move away from the first through hole to compress the at least one elastic member, wherein the at least one elastic member is configured to, once the arresting portion moves past the inclined surface, push one end of the plate towards the first through hole, so that the arresting portion corresponds in position to the shoulder portion.

13. The cigar cutter according to claim 12, wherein the operation key is configured to, when the cigar cutter is in the closed state, be pushed to move the plate away from the first through hole; the elastic element is configured to, once the shoulder portion no longer blocks the arresting portion, drive the rotatable ring to rotate reversely; the rotatable ring is configured to rotate reversely to drive the position-limiting post to slide from the second end of the at least one first position-limiting track toward the first end of the at least one first position-limiting track, to drive the at least one cutting blade unit to stop covering the first and second through holes so that the cigar cutter enters the open state, and to move the arresting portion past the inclined surface again to a position nearer to the first side of than to the second side of the inclined surface.

14. The cigar cutter according to claim 1, wherein the arresting portion is formed as a notch, is located at an edge of the rotatable ring, and is configured to be extended therein with the engaging portion when the arresting portion moves to a position corresponding to the engaging portion.

* * * * *